US009862463B2

(12) United States Patent
Boyeau

(10) Patent No.: US 9,862,463 B2
(45) Date of Patent: Jan. 9, 2018

(54) SEALED, THERMALLY INSULATING VESSEL COMPRISING A CORNER PART

(71) Applicant: Gaztransport et Technigaz, Saint Remy les Chevreuse (FR)

(72) Inventor: Marc Boyeau, Viroflay (FR)

(73) Assignee: Gaztransport ET Technigaz, Saint Remy les Chevreuse (FR)

( * ) Notice: Subject to any disclaimer, the term of this patent is extended or adjusted under 35 U.S.C. 154(b) by 179 days.

(21) Appl. No.: 14/911,389

(22) PCT Filed: Aug. 14, 2014

(86) PCT No.: PCT/FR2014/052094

§ 371 (c)(1),
(2) Date: Feb. 10, 2016

(87) PCT Pub. No.: WO2015/022473

PCT Pub. Date: Feb. 19, 2015

(65) Prior Publication Data

US 2016/0200402 A1 Jul. 14, 2016

(30) Foreign Application Priority Data

Aug. 15, 2013 (FR) ..... 13 58031

(51) Int. Cl.
*F17C 1/12* (2006.01)
*F17C 13/08* (2006.01)
(Continued)

(52) U.S. Cl.
CPC ..... *B63B 27/34* (2013.01); *B63B 3/68* (2013.01); *B63B 25/16* (2013.01); *B63B 27/25* (2013.01);
(Continued)

(58) Field of Classification Search
CPC ..... B63B 27/34; B63B 3/68; B63B 25/16; B63B 25/2725; B17C 2223/033;
(Continued)

(56) References Cited

U.S. PATENT DOCUMENTS 3,800,970 A * 4/1974 Jackson ..... B65D 90/023 220/560.08
4,065,019 A * 12/1977 Letourneur ..... B63B 25/16 114/74 A
(Continued)

FOREIGN PATENT DOCUMENTS

FR 2343965 A1 10/1977
FR 2462336 A1 2/1981
(Continued)

OTHER PUBLICATIONS

International Search Report and Written Opinion, PCT Application No. PCT/FR2014/052094; dated Feb. 24, 2015, 10 pages.

*Primary Examiner* — J. Gregory Pickett
*Assistant Examiner* — Niki M Eloshway

(57) ABSTRACT

Sealed and thermally insulating tank in which a first tank wall and an adjacent second tank wall form an edge, the tank further including a sealed corner piece fixed in a sealed manner to the sealing membrane of the first tank wall and of the second tank wall, the corner piece including a sheet metal corner angle-iron situated in line with the edge, a first reinforcing flange, a second reinforcing flange, a first locking piece, a second locking piece wherein the locking pieces are fixed to the insulating barrier, the first reinforcing flange and the second reinforcing flange each include a tab fixed to the lower face of the first and second locking pieces, respectively.

23 Claims, 9 Drawing Sheets

(51) Int. Cl.

| | |
|---|---|
| ***B63B 27/34*** | (2006.01) |
| ***B63B 3/68*** | (2006.01) |
| ***B63B 25/16*** | (2006.01) |
| ***B63B 27/25*** | (2006.01) |
| ***F17C 3/02*** | (2006.01) |
| *F17C 1/02* | (2006.01) |

(52) U.S. Cl.
CPC ..... *F17C 3/027* (2013.01); *F17C 2201/0157* (2013.01); *F17C 2201/052* (2013.01); *F17C 2203/0358* (2013.01); *F17C 2203/0631* (2013.01); *F17C 2209/23* (2013.01); *F17C 2221/033* (2013.01); *F17C 2223/0161* (2013.01); *F17C 2223/033* (2013.01); *F17C 2260/011* (2013.01); *F17C 2270/0107* (2013.01)

(58) Field of Classification Search
CPC ..... B17C 2260/011; B17C 2270/0107; B17C 3/027; B17C 2201/0153; B17C 2201/052; B17C 2203/0358; B17C 2203/063; B17C 2209/23; B17C 2221/033; B17C 2223/0161
USPC ..... 220/560.12, 560.04, 560.08, 560.11, 220/560.15; 141/1, 82, 231; 137/236.1
See application file for complete search history.

(56) References Cited

U.S. PATENT DOCUMENTS

| | | | | |
|---|---|---|---|---|
| 4,170,952 | A | 10/1979 | McCown | |
| 4,452,162 | A * | 6/1984 | Harbaugh | B63B 25/16 114/74 A |
| 5,450,806 | A * | 9/1995 | Jean | B63B 25/16 114/74 A |
| 5,501,359 | A | 3/1996 | Chauvin et al. | |
| 7,819,273 | B2 * | 10/2010 | Yang | F17C 13/001 220/560.07 |
| 2007/0028823 | A1 * | 2/2007 | Yang | B63B 25/14 114/74 A |
| 2013/0255562 | A1 * | 10/2013 | Canler | F17C 3/027 114/74 A |
| 2014/0124086 | A1 * | 5/2014 | Jean | F17C 3/027 141/1 |
| 2015/0354745 | A1 * | 12/2015 | Tarnay | F16M 11/14 248/371 |
| 2016/0069514 | A1 * | 3/2016 | Delanoe | F17C 3/027 137/1 |
| 2016/0200402 | A1 * | 7/2016 | Boyeau | F17C 3/027 114/74 A |
| 2016/0252210 | A1 * | 9/2016 | Bougault | F17C 3/027 141/1 |
| 2016/0252211 | A1 * | 9/2016 | Boyeau | F17C 3/027 141/1 |

FOREIGN PATENT DOCUMENTS

| | | | |
|---|---|---|---|
| FR | 2691520 | A1 | 11/1993 |
| JP | S59170367 | A | 9/1984 |
| WO | 2015022473 | A2 | 2/2015 |
| WO | 2015022473 | A3 | 2/2015 |

* cited by examiner

SEALED, THERMALLY INSULATING VESSEL COMPRISING A CORNER PART

CROSS-REFERENCE TO RELATED APPLICATION

This application is the National Stage of, and therefore claims the benefit of, International Application No. PCT/FR2014/052094 filed on Aug. 14, 2014, entitled "SEALED, THERMALLY INSULATING VESSEL COMPRISING A CORNER PART," which was published in French under International Publication Number WO 2015/022473 on Feb. 19, 2015. International Application No. PCT/FR2014/052094 claims priority to FR Application No. 1358031 filed on Aug. 15, 2013. Both of the above applications are commonly assigned with this National Stage application and are incorporated herein by reference in their entirety.

TECHNICAL FIELD

The disclosure relates to the field of the manufacture of sealed, thermally insulating vessels. In particular, the present disclosure relates to tanks intended to contain cold liquids, for example tanks for the storage and/or the transportation by sea of liquefied gas.

TECHNOLOGICAL BACKGROUND

Sealed and thermally insulating tanks may be used in various industries to store hot or cold products. For example, in the energy field, liquefied natural gas (LNG) is a liquid that can be stored at atmospheric pressure at approximately −163° C. in storage tanks on land or in tanks onboard floating structures. Such onboard tanks may be intended for the transportation of LNG, for example, or to feed propulsion machinery of a ship.

One such tank is described in the document FR2691520. That tank is integrated into a supporting structure including longitudinally adjacent faces forming edges. The tank wall includes a sealing membrane that includes a plurality of corrugated plates. The corrugations of the plates extend toward the interior of the tank so as to be deformed transversely to follow elastically any deformation of the wall elements of the tank supporting the sealing membrane or thermal deformation of the membrane. At the level of the edges, the membrane includes flexible corner pieces. These corner pieces include sections with waves complementary to the waves provided on the corrugated plates of the membrane carried by the two walls of the tank forming the edge.

SUMMARY OF THE DISCLOSURE

One basic idea of the disclosure is to make possible the production of a tank sealing membrane corner piece that is easy to manufacture and to adapt to different tank shapes and effectively withstands the forces to which the sealing membrane is subjected.

In accordance with one embodiment, the disclosure provides a sealed and thermally insulating tank intended to be integrated into a polyhedral supporting structure, the tank including a plurality of plane tank walls, each tank wall including at least one insulating barrier and at least one sealing membrane, said insulating barrier consisting of a plurality of thermal insulation elements, each thermal insulation element including a block of insulating foam, said insulating barrier carrying a plurality of metal sealing plates fixed to one another in a sealed manner in order to form the sealing membrane, wherein a first tank wall and an adjacent second tank wall form an edge, the tank further including a sealed corner piece situated at the level of the edge, the corner piece including:

- a sheet metal corner angle-iron situated along the edge, the corner angle-iron including a first section that extends in the plane of the sealing membrane of the first tank wall and a second section that extends in the plane of the sealing membrane of the second tank wall,
- a first reinforcing flange and a second reinforcing flange, each reinforcing flange including a respective membrane section and a respective anchor section;
- a first locking piece and a second locking piece;

wherein the first and second sections of the corner angle-iron or the first and second reinforcing flanges of the corner piece are fixed in a sealed manner on the one hand to a metal edge plate of the sealing membrane of the first tank wall and on the other hand to a metal edge plate of the sealing membrane of the second tank wall, and in which tank:

- the insulating barrier of the first tank wall includes a first clearance formed in the blocks of insulating foam along the edge,
- the insulating barrier of the second tank wall includes a second clearance formed in the insulating foam blocks along the edge, the first clearance and the second clearance conjointly forming a groove situated along the edge,
- the membrane section of the first reinforcing flange extends in the plane of the sealing membrane of the first tank wall between the first section of the corner angle-iron and the insulating barrier of the first tank wall or the first locking piece, the first section of the corner angle-iron being fixed to the membrane section of the first reinforcing flange,
- the membrane section of the second reinforcing flange extends in the plane of the sealing membrane of the second tank wall between the second section of the corner angle-iron and the insulating barrier of the second tank wall or the second locking piece, the second section of the corner angle-iron being fixed to the membrane section of the second reinforcing flange,
- the anchor section of the first reinforcing flange, the anchor section of the second reinforcing flange and the locking pieces being accommodated in the groove,
- the first locking piece is fixed to the insulating barrier of the first tank wall in the first clearance and has an upper surface covered by the membrane section of the first reinforcing flange,
- the second locking piece is fixed to the insulating barrier of the second tank wall in the second clearance and has an upper surface covered by the membrane section of the second reinforcing flange,
- the anchor section of the first reinforcing flange and the anchor section of the second reinforcing flange each include a junction section arranged, when the corner piece has been fitted, between the two locking pieces and respectively extending from the membrane section of the first reinforcing flange, respectively second reinforcing flange, to a bottom of the groove,
- the anchor section of the first reinforcing flange and the anchor section of the second reinforcing flange each include a tab bent against a lower face of the first locking piece, respectively the second locking piece, and arranged at the bottom of the groove, the tab of the first reinforcing flange is fixed to the lower face of the first locking piece and the tab of the second reinforcing flange is fixed to the lower face of the second locking piece.

Embodiments of such a tank may include one or more of the following features.

In accordance with one embodiment:

the first clearance includes on the one hand an internal lateral surface extending in the direction of the thickness of the tank wall and on the other hand a bottom, the second clearance includes on the one hand an internal lateral surface extending within the thickness of the tank wall and on the other hand a bottom, the bottom of the first clearance and the bottom of the second clearance conjointly forming the bottom of the groove, the first locking piece includes an external lateral surface opposite the second locking piece, the external lateral face of the first locking piece being fixed, for example glued, to the internal lateral face of the first clearance, the second locking piece includes an external lateral surface opposite the first locking piece, the external lateral face of the second locking piece is fixed, for example glued, to the internal lateral face of the second clearance, the lower face of the first locking piece and the tab of the first reinforcing flange are fixed, for example glued, to the bottom of the first clearance, the lower face of the second locking piece and the tab of the second reinforcing flange are fixed, for example glued, to the bottom of the second clearance.

In accordance with one embodiment, the lower face of the first locking piece and the lower face of the second locking piece each include a spot facing in which are accommodated the tabs of the first reinforcing flange and of the second reinforcing flange, respectively. A surface of the lower face of the first locking piece not including the spot facing is fixed to the bottom of the first clearance and a surface of the lower face of the second locking piece not including the spot facing is fixed to the bottom of the second clearance.

In accordance with one embodiment, the first locking piece is connected to the second locking piece by a mechanical element engaged in the locking pieces perpendicularly to the edge.

In accordance with one embodiment, the mechanical element includes a screw associated with a nut.

In accordance with one embodiment:

each locking piece consists of an elongate beam extending along the edge, the beam of the first locking piece extending parallel to the beam of the second locking piece, a plurality of mechanical elements connect the first locking piece and the second locking piece along the beam, the anchor section of the reinforcing flanges extends between the two locking pieces between two consecutive mechanical elements and is interrupted at the level of the mechanical elements.

In accordance with one embodiment, the insulating barrier of the first tank wall and the insulating barrier of the second tank wall each have an edge surface extending parallel to each other in the direction of the thickness of the tank wall, the edge surfaces of the insulating barrier of the first tank wall and of the second tank wall being fixed together.

In accordance with one embodiment, the edge surface of the insulating barrier of the first tank wall and the edge surface of the insulating barrier of the second tank wall are glued together.

In accordance with one embodiment, the insulating barrier of the first tank wall and the insulating barrier of the second tank wall each have an edge surface extending parallel to each other in the direction of the thickness of the tank wall, the edge surfaces of the insulating barrier of the first tank wall and of the second tank wall not being fixed together.

In accordance with one embodiment, the mechanical element connecting the first locking piece and the second locking piece is elastically deformable in a direction perpendicular to the edge surfaces of the insulating barrier of the first and second tank walls so that the connection between the first locking piece and the second locking piece is elastic.

In accordance with one embodiment, the anchor section of one of the reinforcing flanges includes, in a plane perpendicular to the edge, a stiffener connecting the junction section and the tab of the reinforcing flange, the locking piece covered by the membrane section of said reinforcing flange including a groove in which the stiffener is accommodated.

In accordance with one embodiment, a plurality of stiffeners are situated on each reinforcing flange and spaced regularly along the bend between the tab and the junction section, each locking piece including a plurality of grooves in which the plurality of stiffeners are accommodated.

In accordance with one embodiment, the locking piece is made of high-density foam.

In accordance with one embodiment, the locking piece is made of wood.

In accordance with one embodiment, the angle-iron is a continuous metal sheet.

In accordance with one embodiment, the angle-iron and the reinforcing flanges of the corner piece being made of sheet metal with a low coefficient of expansion.

In accordance with one embodiment, the tab of the first reinforcing flange and the tab of the second reinforcing flange are fixed against the first locking piece and the second locking piece, respectively, by a screw.

In accordance with one embodiment, the insulating barrier of each wall includes a block of insulating foam and a wooden panel, the wooden panel covering an upper face of the block of insulating foam.

In accordance with one embodiment, the sealing membrane of the first tank wall is fixed in a sealed manner to the first section of the corner angle-iron and the sealing membrane of the second tank wall is fixed in a sealed manner to the second section of the corner angle-iron.

In accordance with one embodiment, the corner angle-iron extends along the axis of the edge toward the exterior of the corner piece beyond the locking pieces.

In accordance with one embodiment, the corner angle-iron includes a wave oriented towards the interior of the tank and extending perpendicularly to the edge.

In accordance with one embodiment, each wall of the tank includes, from the interior of the tank toward the exterior of the tank:

a primary sealing membrane formed of the plurality of metal sealing plates fixed to one another in a sealed manner, a primary insulating barrier, a secondary sealing membrane formed by a layer of composite film, and a secondary insulating barrier, and the primary and secondary insulating barriers each include juxtaposed blocks of insulating foam, the foam blocks of the primary insulating barrier being glued to the secondary sealing membrane, the secondary sealing membrane being glued to the foam blocks of the secondary insulating barrier, the foam blocks of the primary insulating barrier of the first tank wall including the first clearance disposed along the edge and the foam blocks of the primary insulating barrier of the second tank wall including the second clearance disposed along the edge.

In accordance with one embodiment, the first clearance and the second clearance are formed throughout the thickness of the blocks of insulating foam of the primary insulating barrier of the first tank wall and the second tank wall, respectively, so that the bottom of the groove is formed by the sealed composite film layer of the secondary sealing membrane of the first tank wall and the second tank wall, respectively.

In accordance with one embodiment, the corner angle-iron includes a lower corner sheet and a superposed upper corner sheet fixed to one another, and the membrane sections of the reinforcing flanges are fixed to the lower corner sheet and the first and second sections of the upper corner sheet cooperate with the edge plates of the primary sealing membrane of the first tank wall and the second tank wall, respectively.

In accordance with one embodiment, the first locking piece has a length in the plane of the first tank wall greater than the thickness of the primary insulating barrier and the second locking piece has a length in the plane of the second tank wall greater than the thickness of the primary insulating barrier.

In accordance with one embodiment, the tank has a polygonal cylinder overall shape, the plane walls of the tank including a bottom wall of polygonal shape and a plurality of peripheral lateral walls around the bottom wall and each upstanding from a respective side of the polygonal bottom wall, the tank including a plurality of said corner pieces, each corner piece being arranged at the level of the edge formed between one side of the bottom wall and the corresponding lateral wall.

Such a tank may form part of a storage installation on land, for example for storing LNG, or be installed in a floating structure, in coastal waters or offshore, notably a methane tanker, a floating storage and regasification unit (FSRU), a floating production storage and offloading unit (FPSO), etc.

In accordance with one embodiment, a ship for the transportation of a cold liquid product includes a double hull and one of the aforementioned tanks disposed in the double hull.

In accordance with one embodiment, the disclosure also provides a method of loading or offloading such a ship, wherein a cold liquid product is routed via insulated pipes from or to a floating storage installation or a storage installation on land to or from the tank of the ship.

In accordance with one embodiment, the disclosure also provides a transfer system for a cold liquid product, the system including the aforementioned ship, insulated pipes arranged to connect the tank installed in the hull of the ship to a floating storage installation or a storage installation on land and a pump for driving a flow of cold liquid product via the insulated pipes from or to the floating storage installation or the storage installation on land to or from the tank of the ship.

Some aspects of the disclosure are based on the idea of providing a corner piece that withstands the various situations of loading of the sealing membrane. Another aspect of the disclosure is to make possible the production of such a corner piece of a tank with a double sealing membrane, which corner piece can be used either for a primary membrane or for a secondary membrane. One aspect of the disclosure is based on the idea of making possible a flexible connection between the insulating barriers of two adjacent tank walls forming an edge. One aspect of the disclosure is to reduce the loads on the corner piece caused by thermal stresses. Another aspect of the disclosure is to make possible a firm connection between the locking pieces and the insulating barrier. To this end, one aspect of the disclosure is based on the idea of giving preference to the fixing between the locking pieces and the insulating barriers working in traction rather than in shear.

BRIEF DESCRIPTION OF THE FIGURES

The disclosure will be better understood and other objects, details, features and advantages thereof will become more clearly apparent in the course of the following description with reference to the appended drawings of particular embodiments of the disclosure provided by way of illustrative and nonlimiting example only.

DETAILED DESCRIPTION OF EMBODIMENTS

The figures are described hereinafter in the framework of a supporting structure constituted by the internal walls of a double hull of a methane tanker. Such a supporting structure has a prismatic structure. To be more precise, longitudinal walls extend parallel to the longitudinal direction of the ship and form a polygonal section in a plane perpendicular to the longitudinal direction of the ship. The longitudinal walls join at longitudinal edges that in an octagonal geometry form angles of the order of about 135°, for example.

The longitudinal walls of the supporting structure may be interrupted in the longitudinal direction of the ship by transverse supporting walls that are perpendicular to the longitudinal direction of the ship. The longitudinal walls and the transverse walls join at the level of front and rear edges.

Figure 1:
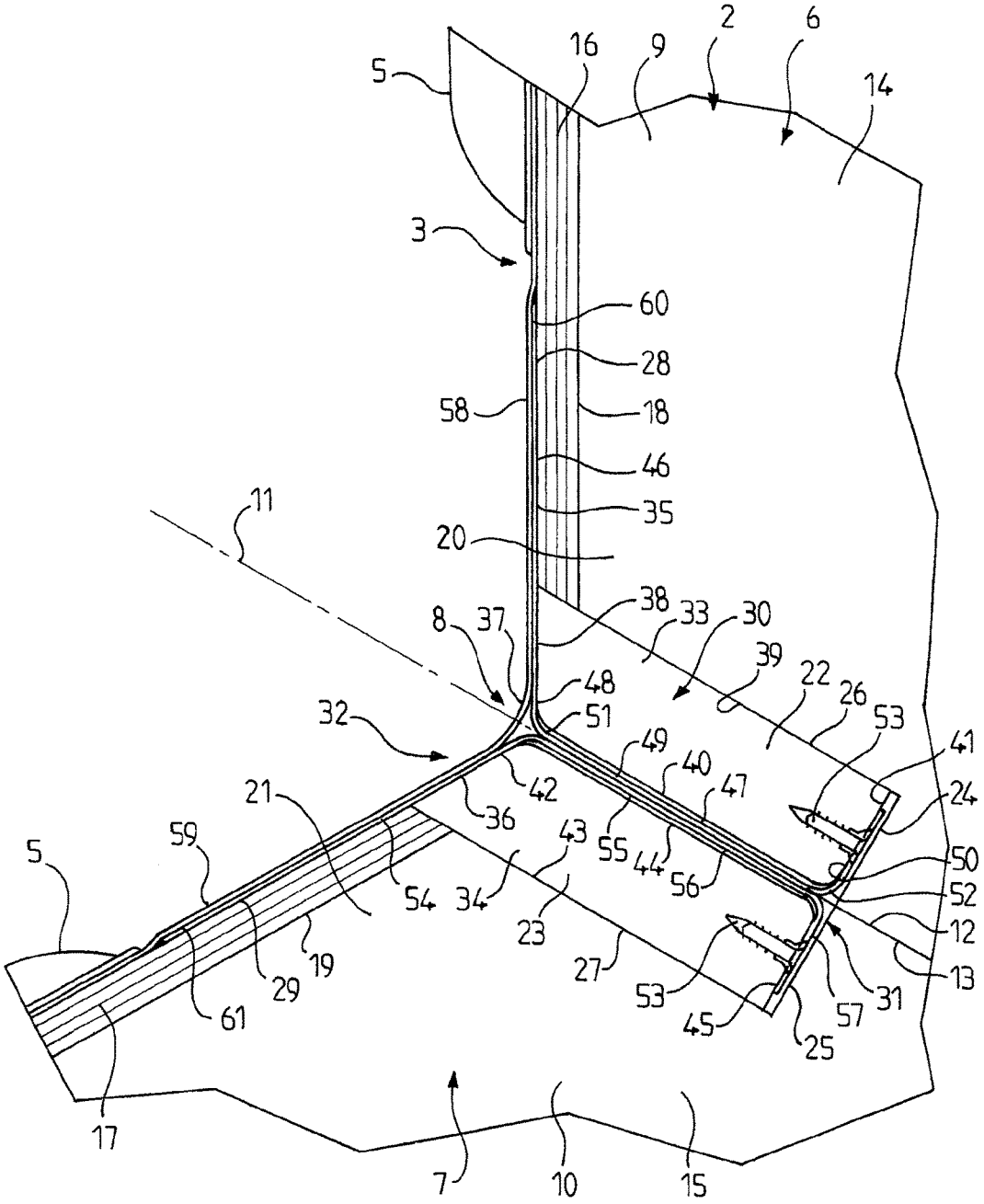
FIG. 1 is a view in section taken along the line I-II in FIG. 3 of a corner between two longitudinal walls of a sealed and thermally insulating storage tank including a corner piece anchored in the insulating barrier of the tank.

Referring to FIG. 1, each wall of the supporting structure (not shown) carries a tank wall. Each of the tank walls consists of at least one thermally insulating barrier 2 carrying a sealing membrane 3.

A thermally insulating barrier 2 is constituted of a plurality of thermal insulation elements (not shown). Each thermal insulation element includes a block of insulating foam to which is fixed a plywood panel. These thermal insulation elements are juxtaposed in accordance with a regular rectangular mesh pattern over (e.g., all of the) surface of the walls of the supporting structure in order to form a plane surface to which the sealing membrane 3 is anchored. Anchor members (not shown) hold the thermal insulation elements pressed onto the supporting structure. Such anchor members are notably described in the published French patent application FR2691520. The anchor members are fixed to the supporting structure by means of pins (not shown) welded to the supporting structure. The thermal insulation elements of the thermally insulating barrier 2 rest on the supporting walls via mastic beads forming parallel rectilinear or undulating lines.

A sealing membrane 3 is constituted of a plurality of metal plates 5 juxtaposed to one another with an overlap. These metal plates 5 may be welded together in order to seal the sealing membrane 3. In order to allow deformation of the sealing membrane 3 in response to the various loads to which the tank is subjected, in particular in response to thermal contraction resulting from loading LNG at −163° C. into the tank, the metal plates 5 include a plurality of corrugations oriented toward the interior of the tank. These corrugations are deformed in response to these loads in order to preserve the seal of the sealing membrane 3.

By convention, the adjective "upper" applied to an element of the tank designates the part of that element oriented toward the interior of the tank and the adjective "lower" designates the part of that element oriented toward the exterior of the tank, regardless of the orientation of the tank wall relative to the terrestrial gravity field. Similarly, the term "above" designates a position situated closer to the interior of the tank and the term "below" a position situated closer to the supporting structure 1, regardless of the orientation of the tank wall relative to the terrestrial gravity field.

FIG. 1 shows a sectional detail view of a sealed and thermally insulating storage tank corner at the level of a longitudinal edge of the ship including a corner piece anchored into the insulating barrier of the tank.

A first longitudinal tank wall 6 and an adjacent second longitudinal tank wall 7 conjointly form a longitudinal edge 8 of the tank. To ensure the continuity of the insulating barrier 2 at the level of the edge 8, a thermal insulation corner element 9, 10 is disposed in the insulating barrier 2 on each side of a bisector plane 11 formed by the two tank walls 6 and 7. An edge face 12 of the corner thermal insulation element 9 of the first tank wall 6 is joined along the edge 8 to an edge face 13 of the corner thermal insulation element 10 of the second tank wall 7. The corner elements 9, 10 may be therefore adjacent on each side of the bisector plane 11. Each of the corner elements 9, 10 includes a block 14, 15 of insulating foam. This block 14, 15 of insulating foam is a block of high-density polyurethane foam, for example, with a density of the order of 130 kg/m$^3$, for example. The corner thermal insulation elements 9, 10 also include a plywood panel 16, 17. This plywood panel 16, 17 is situated on a respective upper face 18, 19 of the respective block 14, 15 of insulating foam. The corner elements 9, 10 extend parallel to the walls of the supporting structure (not shown). The corner elements 9, 10 may be independent of the other thermal insulation elements (not shown) adjacent the first tank wall 6 and the second tank wall 7, respectively.

Each corner thermal insulation element 9, 10 include a cutout. This cut-out is made along the upper longitudinal edge 20, 21 of the corner thermal insulation elements 9, 10 that is adjacent the bisector plane 11. These cut-outs of the corner thermal insulation elements 9, 10 delimit a respective half-groove 22, 23. Each half-groove 22, 23 includes a bottom 24, 25 lying in a plane perpendicular to the bisector plane 11. Each half-groove 22, 23 includes an internal lateral face 26, 27 lying in a plane parallel to the bisector plane 11. The internal lateral face 26, 27 of each half-groove 22, 23 extends from the bottom 24, 25 of the half-grooves to an upper face 28, 29 of the corner thermal insulation element 9, 10. The cut-outs forming the half-grooves 22, 23 may be produced in the blocks 14, 15 of insulating foam and in the plywood panels 16, 17. These two half-grooves 22, 23 may be symmetrical with respect to the bisector plane 11 and conjointly form a groove 30. A bottom 31 of the groove is formed conjointly by the bottom 24 of the first half-groove 22 and the bottom 25 of the second half-groove 23.

In order to ensure the continuity of the sealing membrane 3 at the level of the edge 8, a corner piece 32 is accommodated in the groove 30. A metal edge plate 5 of the first tank wall 6 and a metal edge plate 5 of the second tank wall 7 may be both fixed in a sealed manner to the corner piece 32. Such fixing in a sealed manner is produced by welding the metal edge plates 5 of the tank walls 6, 7 to the corner piece 32, for example. The corner piece 32 includes a first locking piece 33 and a second locking piece 34. The corner piece 32 also includes a first reinforcing flange 35 and a second reinforcing flange 36. The corner piece 32 further includes a corner angle-iron 37.

The first locking piece 33 has a shape complementary to that of the first half-groove 22. The first locking piece 33 takes the form of a wooden beam extending in the first half-groove 22 along the edge 8. The first locking piece 33 includes an upper face 38 lying in the plane of the upper face 28 of the corner thermal insulation element 9 of the first tank wall 6. The first locking piece 33 includes an external lateral face 39 extending along the internal lateral face 26 of the first half-groove 22. The first locking piece 33 includes an internal lateral face 40 opposite the external lateral face 39 and extending parallel to the bisector plane 11. The first locking piece 33 includes an interior face 41 extending along the bottom 24 of the first half-groove 22. The external lateral face 39 of the first locking piece 33 is intended to be fixed against the internal lateral face 26 of the first half-groove 22, for example gluing it to the latter. Similarly, the lower face 41 of the first locking piece 33 is intended to be fixed against the bottom 24 of the first half-groove 22, for example by gluing it thereto.

The second locking piece 34 has a shape complementary to that of the second half-groove 23 and is symmetrical with the first locking piece 33 with respect to the bisector plane 11. Thus the second locking piece 34 includes an upper face 42, an external lateral face 43, an internal lateral face 44 and a lower face 45. Similarly, the external lateral face 43 of the second locking piece 34 is intended to be fixed against the internal lateral face 27 of the second half-groove 23, for example by gluing it to the latter. The lower face 45 of the second locking piece 34 is intended to be fixed against the bottom 25 of the second half-groove 23, for example by gluing it to the latter.

The first reinforcing flange 35 includes a membrane section 46 and an anchor section 47. The first reinforcing flange 35 takes the form of a bent metal sheet extending along the edge 8.

The membrane section 46 of the first reinforcing flange 35 extends in the plane of the sealing membrane 3 of the first tank wall 6. The membrane section 46 of the first reinforcing flange 35 covers the upper face 38 of the first locking piece 33. An edge 48 of the membrane section 46 is joined to the anchor section 47 of the first reinforcing flange 35. The first edge 48 of the membrane section 46 is adjacent the bisector plane 11.

The anchor section 47 of the first reinforcing flange 35 includes a junction 49 and a tab 50. The junction section 49 extends parallel to the bisector plane 11 along said bisector plane 11. A first edge 51 of the junction section 49 is joined to the edge 48 of the membrane section 46. A second edge 52 of the junction section 49 opposite its first edge 51 is adjacent the bottom 31 of the groove 30. The second edge 52 is joined to the tab 50.

The tab 50 of the anchor section 47 of the first reinforcing flange 35 is bent against the lower face 41 of the first locking piece 31. The first reinforcing flange 35 typically has a shape complementary to that of the first locking piece 33. The first reinforcing flange 35 espouses the upper face 38, the internal lateral face 40 and the lower face 41 of the first locking piece 33. The first reinforcing flange 35 is fixed to the first locking piece 33 by any appropriate means, for example by screwing the tab 50 of the first reinforcing flange 35 to the lower face 41 of the first locking piece 33. Such screwing employs wood screws 53, for example.

The second reinforcing flange 36 is similar to the first reinforcing flange 35. This second reinforcing flange includes a membrane section 54 and an anchor section 55. The anchor section 55 of the second reinforcing flange 36 includes a junction section 56 and a tab 57.

The second reinforcing flange 36 is symmetrical to the first reinforcing flange 35 with respect to the bisector plane 11 and espouses the shape of the upper face 42, the internal lateral face 44 and the lower face 45 of the second locking piece 23. The second reinforcing flange 36 is fixed to the second locking piece 34 by any appropriate means, for example by screwing the tab 57 of the second reinforcing flange 36 to the lower face 45 of the second locking piece 34.

The corner angle-iron 37 takes the form of a metal sheet bent to the angle formed by the first tank wall 6 and the second tank wall 7, for example 135°. The corner angle-iron 37 extends along the edge 8. A first section 58 of the corner angle-iron 37 extends in the plane of the sealing membrane 3 of the first tank wall 6. A second section 59 of the corner angle-iron 37 extends in the plane of the sealing membrane 3 of the second tank wall 7.

In order to preserve the seal of the sealing membrane 3, the metal edge plate 5 of the first tank wall 6 is welded in a sealed manner to the first section 58 of the corner angle-iron and the metal edge plate 5 of the second tank wall 7 is welded in a sealed manner to the second section 59 of the corner angle-iron. In this embodiment, the fixing between the corner angle-iron 37 and the reinforcing flanges 35, 36 does not need to be sealed, the seal being provided by the corner angle-iron 37 and the metal edge plates 5.

In a variant embodiment, the corner angle-iron 37 may be fixed in a sealed manner to the reinforcing flanges 35, 36. The sealing membrane 3 of the tank walls 6, 7 may then be directly fixed in a sealed manner to the reinforcing flanges 35, 36. One such variant can be seen in FIG. 8, for example.

The first section 58 of the corner angle-iron 37 is fixed to the membrane section 46 of the first reinforcing flange 35. The membrane section 46 of the first reinforcing flange 35 is situated between the upper face 38 of the first locking piece and a lower face 60 of the first section 58 of the corner angle-iron 37.

The second section 59 of the corner angle-iron 37 is fixed to the membrane section 54 of the second reinforcing flange 36, the membrane section 54 of the second reinforcing flange 36 is situated between the upper face 42 of the second locking piece 34 and a lower face 61 of the second section 59 of the corner angle-iron 37. The corner angle-iron 37 is fixed to the membrane sections 46, 54 of the reinforcing flanges 35, 36 by any appropriate means, for example by welding.

The reinforcing flanges 35, 36 and the corner angle-iron 37 may be made of sheet metal with a low coefficient of expansion, for example the nickel alloy known as INVAR®. The corner angle-iron 37 is extremely simple to manufacture because it suffices to bend a metal sheet to the required angle, for example the angle of 135° formed by the first tank wall 6 and the second tank wall 7. Similarly, the reinforcing flanges 35, 36 may be very simple to manufacture because they also necessitate only bending the metal sheet to the required angle. A first sheet bending operation enables the formation of an angle of 90° between the junction section 49, 56 and the tab 50, 57. A second bending operation enables the formation of an angle corresponding to the angle formed between the bisector plane 11 and the upper face 28, 29 of the corner thermal insulation elements 9, 10 between the membrane section 46, 54 and the anchor section 47, 55.

Similarly, the locking pieces 33, 34 may also be simple to manufacture because they are merely wooden beams the upper face 38, 42 of which is beveled at the angle formed by the bisector plane 11 and the upper face 28, 29 of the corner thermal insulation elements 9, 10.

In order to absorb stresses loading the tank at the level of the edge 8, in particular stresses linked to thermal contraction on loading LNG into the tank, the anchor piece 32 is anchored in the groove 30. To this end, the external lateral faces 39, 43 of the locking pieces 33, 34 may be glued against the internal lateral faces 26, 27 of the half-grooves 22, 23, respectively. Similarly, a lower face of the corner piece 32 is fixed against the bottom 31 of the groove 30.

Finally, the edge faces 12, 13 of the corner thermal insulation blocks 9, 10 may be glued together. Such gluing between the edge faces 12, 13 of the corner thermal insulation blocks 9, 10 may be continuous or discontinuous.

When loading LNG into the tank, the contraction of the sealing membrane 3 of the first tank wall 6 and of the second tank wall 7 exerts traction on the corner piece 32. Anchoring the corner piece 32 in the groove 30 makes it possible for the corner piece 32 to absorb these stresses. More particularly, when loading LNG into the tank, traction is exerted on the corner angle-iron 37 by the sealing membrane 3 via the fixing of the metal edge plates 5 to the corner angle-iron 37. The connection between the corner angle-iron 37 and the reinforcing flanges 35, 36 transmits this traction to the reinforcing flanges 35, 36. The reinforcing flanges 35, 36 being anchored to the locking pieces 33, 34, the traction is transmitted to the locking pieces 33, 34. Anchoring the locking pieces 33, 34 in the groove 30 makes it possible to absorb these traction stresses. Producing the corner angle-iron 37 in the form of a continuous mechanical sheet metal part and fixing the metal edge plates 5 to the corner angle-iron 37 seals the sealing membrane 3 at the level of the edge 8.

Figure 2:
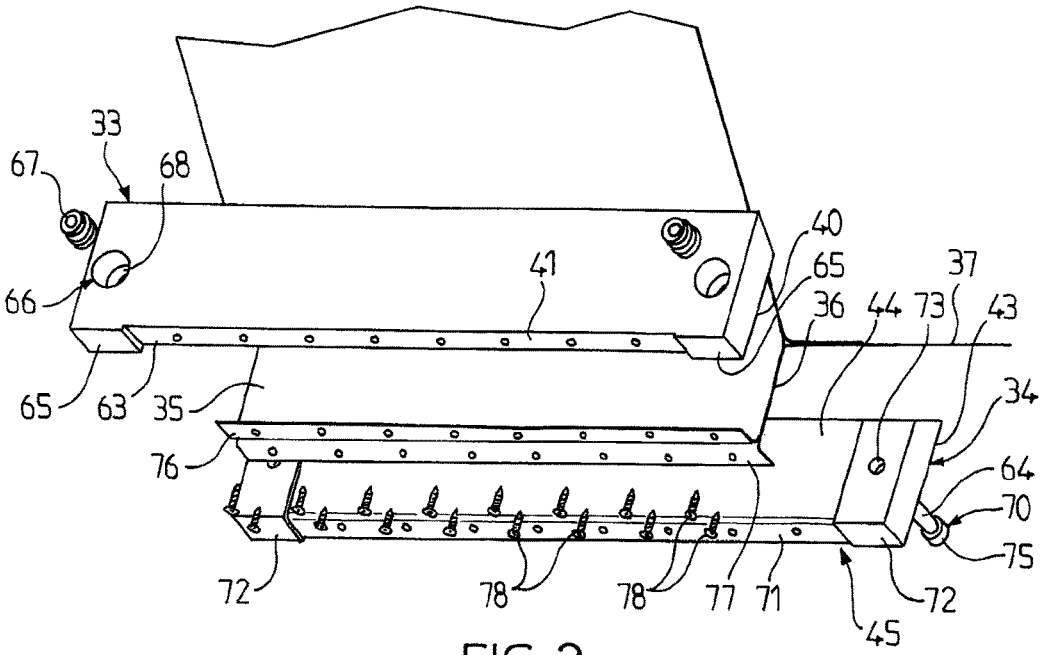
FIG. 2 is a diagrammatic exploded perspective view of a corner piece from FIG. 1.

FIG. 2 is a diagrammatic exploded perspective view of a corner piece from FIG. 1.

The first locking piece 33 includes a spot facing 63 situated on a central part of the lower face 41 of the first locking piece 33. Ends of the lower face 41 situated on each side of the spot facing 63 form a lower edge surface 65 of the first locking piece 33. The spot facing 63 is made to a thickness substantially equal to the thickness of the tab 50 of the first reinforcing flange 34. A plurality of screw holes is regularly spaced in the bottom of the spot facing 63.

The first locking piece 33 includes on its external lateral face 39 in line with the lower edge surfaces 65 nut housings 66 with a shape complementary to that of nuts 67. A bottom 68 of a nut housing 66 has a hole through it (not shown). This hole opens on the one hand onto the internal lateral face 40 of the first locking piece 33 and on the other hand onto the bottom 68 of said nut housing 66. This hole has a diameter slightly greater than that of the threaded part 64 of a clamping screw 70.

The second locking piece 34 has on its lower face 45 a spot facing 71 and lower edge surfaces 72 analogous to the spot facing 63 and the edge surfaces 65 described above with reference to the first locking piece 33. The second locking piece 34 includes on its internal lateral face 44, facing each hole of the nut housings 66 of the first locking piece 33, holes 73 passing through it. A hole 73 of the second locking piece 34 opens on the one hand onto the internal lateral face 44 of the second locking piece 34 and on the other hand into a clamping screw head housing. This hole 73 has a diameter slightly greater than the diameter of the threaded part 64 of the clamping screw 70. A screw head housing (not shown) is situated on the external lateral face 43 of the second locking piece 34 in line with each lower edge surface 72 and has a shape complementary to that of a head 75 of the clamping screw 70.

The reinforcing flanges 35, 36 extend only at the level of the spot facings 63, 71 of the locking pieces 33, 34. The length of the reinforcing flange 35, 36 along the axis of the edge 8 is typically equal to the length of the spot facings 63, 71 along that same axis of the edge 8. Similarly, the length along the axis of the edge 8 of the corner angle-iron 37 is equal to the length of the spot facings 63, 71 along that same axis of the edge 8. The anchor sections 47, 55 and the membrane sections 46, 54 of each reinforcing flange 35, 36 therefore extend only between two planes perpendicular to the axis of the edge 8 and joined both to the spot facings 63, 71 and to the lower edge surfaces 65, 72. The corner angle-iron 37 also extends only between these two planes perpendicular to the axis of the edge 8 and joined both to the spot facings 63, 71 and to the lower edge surfaces 65, 72.

Figure 3:
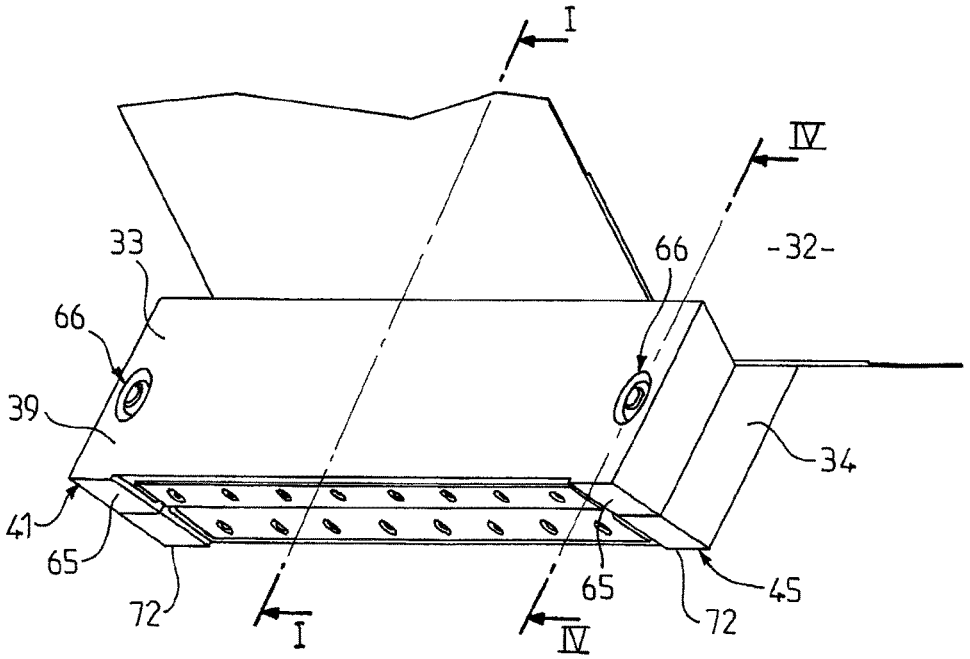
FIG. 3 is a diagrammatic perspective view of the corner piece from FIG. 2 when fitted.

FIG. 3 represents a diagrammatic perspective view of a corner piece from FIG. 1 when fitted.

When the corner piece 32 is fitted, the tabs 50, 57 of the reinforcing flanges 35, 36 may be accommodated in the spot facings 63, 71 of the lower faces 41, 45 of the locking pieces 33, 34. A lower face 76, 77 of the tabs 50, 57 is flush with the lower edge surfaces 65, 72. The tabs 50, 57 of the reinforcing flanges 35, 36, in one embodiment, are screwed to the locking pieces 33, 34 by a plurality of screws 78 screwed into the locking pieces 33, 34 at the level of the spot facings 63, 71.

The first locking piece 33 is connected to the second locking piece 34 by the clamping screws 70. The head 75 of the clamping screws 70 bears against the bottom of the screw head housings of the second locking piece 34. The nuts 67 may be mounted on the threaded part 64 of the screw 70 and bear against the bottom 68 of the nut housings 66 of the first locking piece 33.

At the level of the longitudinal edge 8, corner pieces 32 when fitted extend in the groove 30 substantially all the length of the longitudinal edge 8. To this end, a plurality of corner pieces 32 are anchored one after the other in the groove 30. The angle piece 32 is anchored by gluing it into the groove 30 both at the level of the lower edge surfaces 65, 72 of the locking pieces 33, 34 and the lower faces 76, 77 of the tabs 50, 57 of the reinforcing flanges 35, 36.

A welding strip made of sheet metal, for example of INVAR®, is fixed in a sealed manner to the ends of two consecutive corner pieces 32. Such a welding strip also covers the upper face of the edges of two consecutive locking pieces 33, 34 not covered by the reinforcing flanges 35, 36. This welding strip seals the sealing membrane 3 between two consecutive corner pieces 32 along an edge 8.

Figure 4:
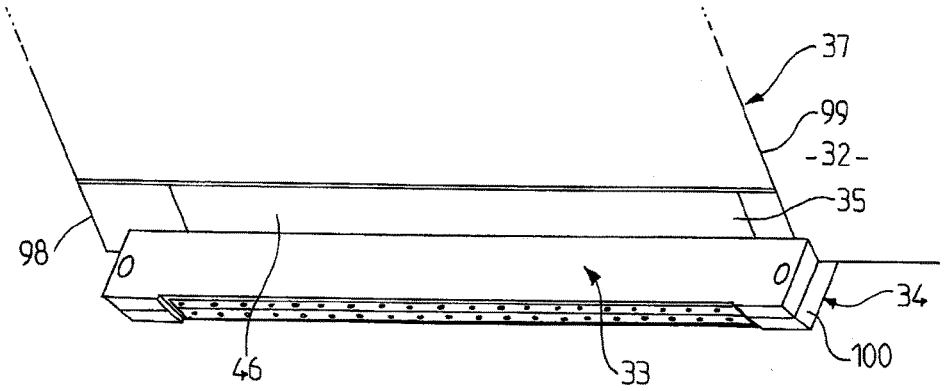
FIG. 4 represents a diagrammatic perspective view of another embodiment of the corner piece when fitted.

FIG. 4 represents a diagrammatic perspective view of one embodiment of the corner piece 32 when fitted.

In this embodiment, the locking pieces and the reinforcing flanges have the same features as the locking pieces and the reinforcing flanges from FIG. 2 and carry the same reference numbers. The locking pieces 33, 34 may be connected together by the clamping screws 70 and the nuts 66 as described with reference to FIGS. 2 and 3.

In this embodiment, the corner angle-iron 37 has a shape similar to that of the corner pieces from FIGS. 2 and 3 but has different dimensions along the axis of the edge 8. Accordingly, in the embodiment shown in FIG. 4, a first longitudinal end 98 of the corner angle-iron 37 extends toward the outside of the corner piece 32 beyond the locking pieces 33, 34 along the axis of the edge 8. A second longitudinal end 99 of the corner angle-iron 37, opposite the first longitudinal end 98, extends, when projected into a plane parallel to the axis of the edge 8, between the membrane sections 46, 54 of the reinforcing flanges 35, 36 and a longitudinal edge face 100 of the corner piece 32.

The corner pieces 32 may be mounted in the groove 30 and juxtaposed to one another all along the longitudinal edge 8. A first corner piece is mounted in the groove 30 so that the first longitudinal end 98 of its corner angle-iron 37 covers the second longitudinal end 98 of an adjacent second corner piece. The first longitudinal end 98 of the corner angle-iron 37 of the first corner piece is then fixed in a sealed manner to the second longitudinal end 98 of the corner angle-iron 37 of the second corner piece.

Such a sealed weld makes it possible to guarantee the seal of the sealing membrane. Moreover, corner pieces 32 in accordance with this embodiment do not necessitate the installation of a welding strip as is the case for the corner pieces from FIGS. 2 and 3. A single sealed weld is necessary and sufficient to guarantee the seal between two consecutive corner pieces in the groove.

Figure 5:
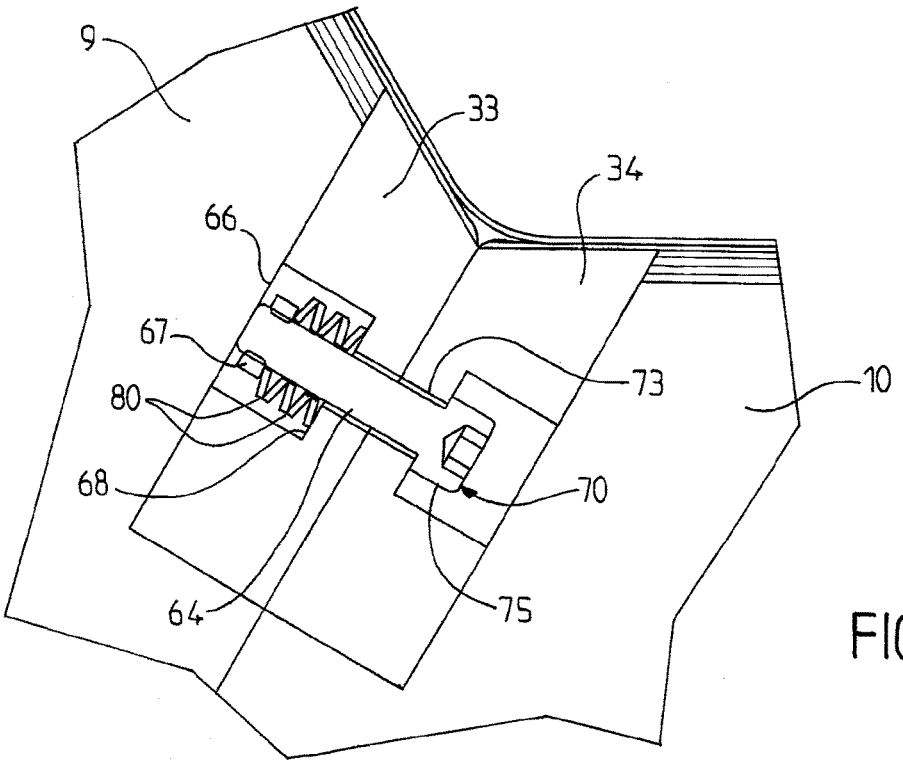
FIG. 5 is a view in section of the tank corner from FIG. 1 taken along the line IV-IV in FIG. 3, namely at the level of a mechanical element connecting the first locking piece and the second locking piece.

FIG. 5 represents a sectional view of a tank corner as in FIG. 1 at the level of a mechanical element connecting the first locking piece and the second locking piece when the connection between the first locking piece 33 and the second locking piece 34 is elastic. Such a connection may be produced by any appropriate means, for example by inserting Belleville washers 80 between the nut 67 and the bottom 68 of the nut housing 66. These Belleville washers 80 allow flexibility in the mechanical connection between the locking pieces 33 and 34. In this variant, the corner thermal insulation elements 9, 10 of the tank walls 6, 7 are not glued together.

Accordingly, in the presence of a stress, for example caused by thermal contraction of the sealing membrane 3, the flexibility offered on the one hand by the absence of any connection between the corner thermal insulation elements 9, 10 and on the other hand by the elasticity of the connection between the locking pieces 33, 34 enables at least partial absorption of the stress by the elasticity of the connection between the locking pieces 33, 34.

FIGS. 6 to 9 represent a tank corner including a double insulating barrier and a double sealing membrane in which there is a corner piece from FIGS. 2 and 3 for each sealing membrane.

The same elements described above for a tank including a single insulating barrier 2 and a single sealing membrane 3 are generally designated in the context of a tank with double insulating barrier and double sealing membrane under the same reference numbers to which an "A" is added when this refers to the secondary insulating barrier or the secondary sealing membrane and to which a "B" is added when this refers to the primary insulating barrier or the primary sealing membrane.

Thus the double membrane tank includes, from the supporting structure to the interior of the tank, a secondary insulating barrier 2A, a secondary sealing member 3A, a primary insulating barrier 2B and a primary sealing membrane 3B.

At the level of the edge 8, the secondary sealing membrane 3A forms a secondary edge 8A and the primary sealing membrane 3B forms a primary edge 8B. The secondary insulating barrier 2A includes corner thermal insulation elements 9A, 10A as described above and the primary insulating barrier 2B includes corner thermal insulating elements 9B, 10B as described above. A secondary corner piece 32A as described above is anchored in a secondary groove 30A formed by the secondary corner thermal insulation elements 9A, 10A of the secondary insulating barrier 2A. A primary corner piece 32B is anchored in a primary groove 30B formed by the primary corner thermal insulation elements 9B, 10B of the primary insulating barrier 2B. Secondary metal edge plates 5A of the first tank wall 6 may be anchored in a sealed manner to the secondary corner piece 32A. The secondary metal plates 5A of the second tank wall 7 may be anchored in a sealed manner to the secondary corner piece 32A. The primary metal plates 5B of the first tank wall 6 may be anchored in a sealed manner to the primary corner piece 32B. The primary metal plates 5B of the second tank wall 7 may be anchored in a sealed manner to the primary corner piece 32B.

Edge faces 12A, 13A of the corner thermal insulation elements 9A, 10A of the secondary insulating barrier 2A situated in the bisector plane 11 are glued together. Edge faces 12B, 13B of the corner thermal insulation elements 9B, 10B of the primary insulating barrier 2B situated in the bisector plane 11 are glued together.

Figure 6:
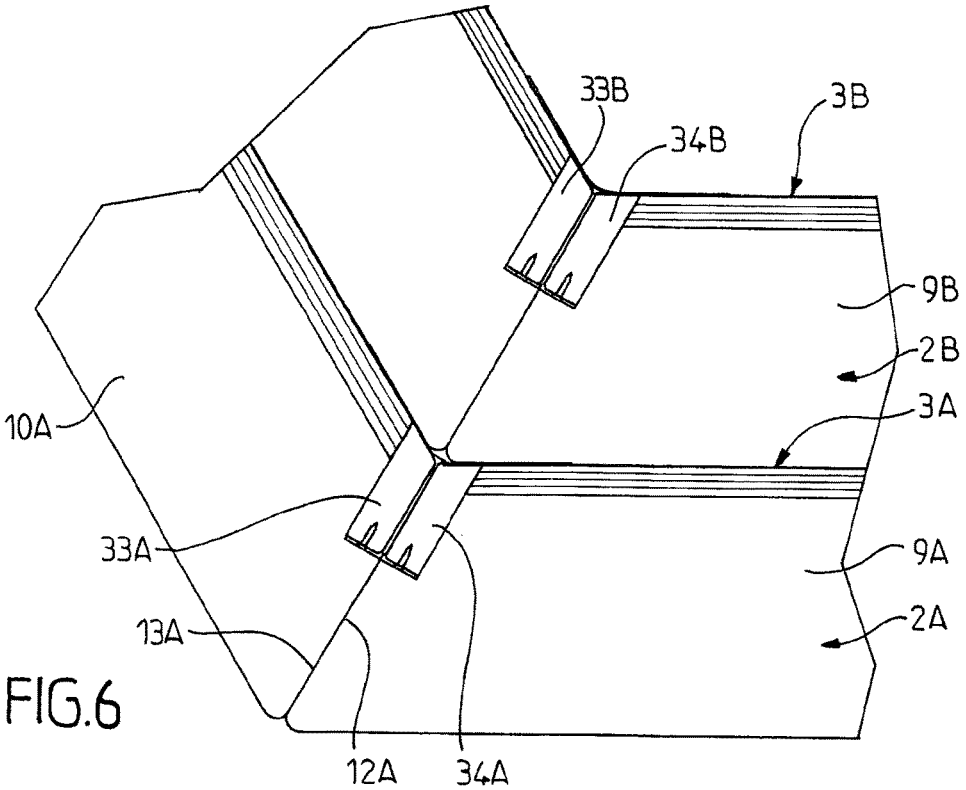
FIG. 6 is a view in section of a tank corner including a double insulating barrier and a double sealing membrane and in which a corner piece from FIGS. 2 and 3 is provided for each sealing membrane.
Figure 7:
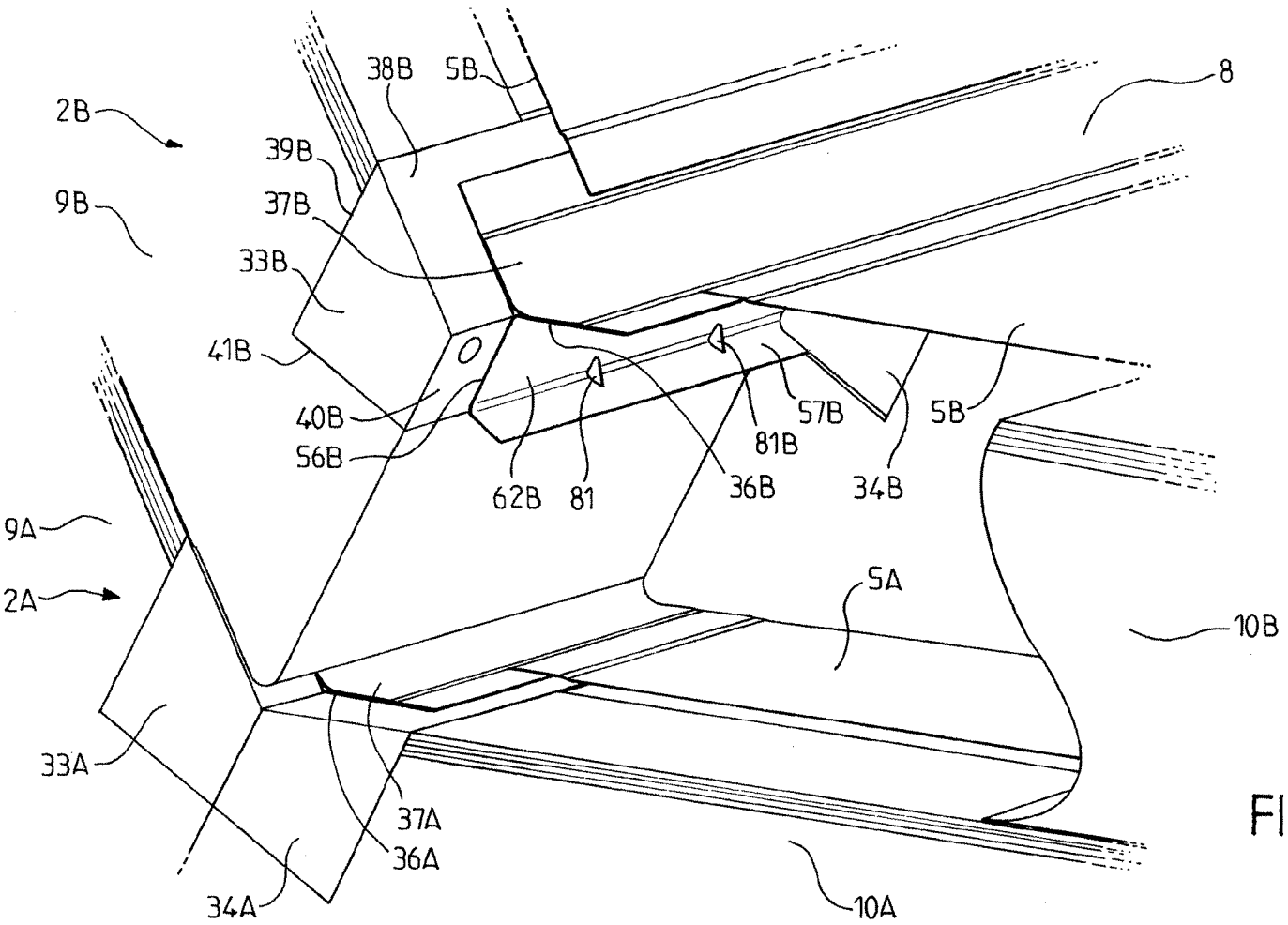
FIG. 7 is a cutaway perspective view of the tank corner from FIG. 6 in which a corner piece in accordance with a second embodiment is used.

FIG. 7 represents a cutaway view of the tank corner from FIG. 6 in which the corner piece is modified: stiffeners are installed between the tab 57B and the junction section 56B of the anchor section 55B of the second primary reinforcing flange 36B.

Stiffeners 81B may be regularly spaced along the whole of the second edge 62B of the junction section 56B of the second primary reinforcing flange 36B. These stiffeners 81B are for example merely triangular flat sheet metal pieces extending in planes perpendicular to the direction of the edge 8. The second secondary locking piece 34B advantageously includes grooves (not shown) with shapes complementary to the shapes of the stiffeners 81B. The stiffeners 81B may be accommodated in these grooves.

In the presence of a stress on the sealing member 3, for example caused by thermal contraction in response to loading LNG into the tank 1, a force exerted on the corner piece 32 is retransmitted in the form of a shear force to the anchor screws 78 between the tab 57B of the second primary reinforcing flange 36B and the lower face 45B of the second primary locking piece 34B. The tab 57B is typically pulled toward the junction section 56B of the second primary reinforcing flange 36B and, like a sheet of paper espousing the contours of an outside right angle, the bend between the junction section 56B and the tab 57B tends to move along the anchor section 55B and to reduce the width of the tab 57B along an axis perpendicular to the bisector plane 11.

This movement of the bend is prevented by the anchor screws 78 that hold the tab 57B in position on the second locking piece 34. However, the anchor screws 78 are therefore subjected to a harmful shear force. The stiffeners 81B stiffen the bend between the junction section 56B and the tab 57B, thereby preventing movement of the bend along the anchor section 55B. The stiffened bend therefore remains in position and retains its shape in the anchor section 55B. The stress exerted on the corner piece 32 is therefore not reflected in a shear force on the anchor screws 78 but in a traction force seeking to pull the anchor screws 78 out of the second locking piece 34. In the presence of such stiffeners 81B, the screw fixing between the tab 57B and the second secondary locking piece 34B may be dispensed with, the preservation of the characteristics of the bend between the junction section 56B and the tab 57B associated with the complementary relationship of the anchor section 55B and the second locking piece 34 makes it possible to hold the second reinforcing flange 36 against the second locking piece 34 even in the presence of stresses. Such stiffeners 81B may equally well be installed on each reinforcing flange 35, 36 of each sealing membrane 3A, 3B.

In this variant, an intermediate secondary metal plate is fixed in a sealed manner to the secondary corner angle-iron 37A, the metal edge plates (not shown) of the tank walls 6, 7 being fixed in a sealed manner to this intermediate secondary metal plate.

Figure 8:
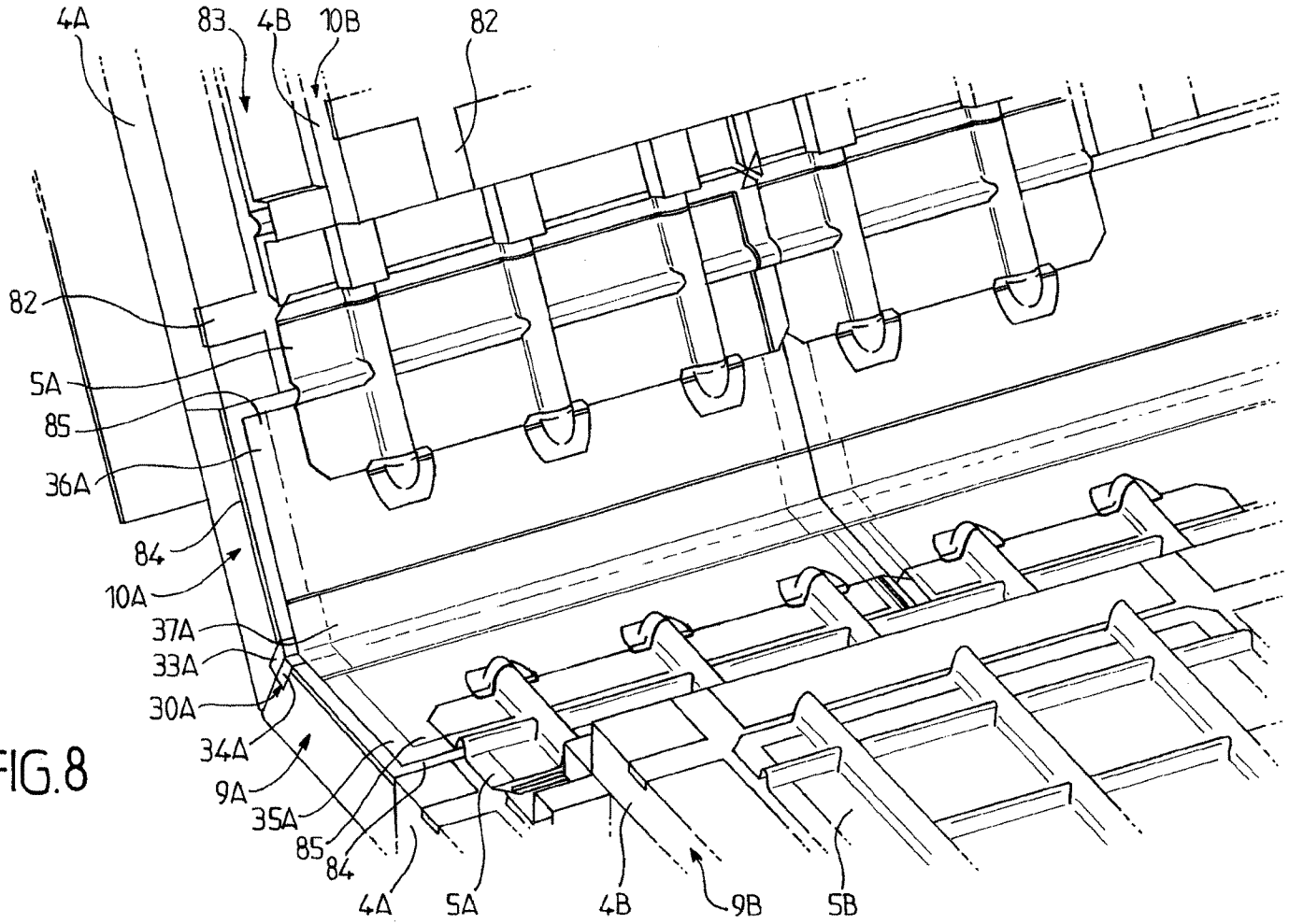
FIG. 8 is a cutaway perspective view of the tank corner from FIG. 6 in which the primary barrier has been omitted at the level of the corner to allow the secondary barrier to be seen.

FIG. 8 represents a cutaway view of the sealed and thermally insulating tank corner including the double sealing membrane and the double insulating barrier. The primary insulating barrier and the primary sealing membrane are omitted at the level of the edge to show the corner piece at the level of the secondary sealing membrane.

In this embodiment, the secondary sealing membrane 3A includes a plurality of juxtaposed secondary corrugated sealing metal plates 5A. The secondary corrugated metal plates 5A may be fixed to one another in a sealed manner.

The secondary insulating barrier 2A includes a plurality of secondary thermal insulation elements 4A. An upper face of the secondary thermal insulation elements 4A includes metal anchor blades 82A to which are anchored the corrugated metal plates 5A of the secondary sealing membrane 3A. A protection shell 83 covers the corrugations of the secondary sealing metal plates 5A.

Primary thermal insulation elements 4B rest on the protection shell 83. An upper face of the primary thermal insulation elements 4B includes anchor blades 82B to which are anchored the primary corrugated sealing plates 5B. These primary corrugated sealing plates 5B are intended to be in contact with the LNG stored in the tank 1.

As described above with reference to FIG. 7, a plurality of secondary corner thermal insulation elements 9A, 10A are situated along the secondary edge 8A. The secondary corner thermal insulation elements 9A, 10A form the secondary groove 30A extending along the secondary edge 8A. Each secondary corner thermal insulation element 9A, 10A includes a spot facing on its upper face 28A, 29A. A plurality of metal blades 84 are accommodated in the spot facings of the upper faces 28A, 29A of the secondary corner thermal insulation elements 9A, 10A.

A plurality of secondary corner pieces 32A may be anchored one after another in the secondary groove 30A. The membrane sections 46A, 54A of the secondary reinforcing flanges 35A, 36A of each anchor piece 32A may be fixed to the metal blades 84 of the corner thermal insulation elements 9A, 10A. This fixing is achieved by any appropriate means, for example by welding.

The membrane sections 46A, 54A of the secondary reinforcing flanges 35A, 36A have a second edge 85 opposite the first edge 48A of the membrane sections 46A, 54A of the reinforcing flanges 35A, 36A. The secondary metal edge plates 5A of the first tank wall 6 may be anchored in a sealed manner to the second edge 85 of the first secondary reinforcing flange 35A opposite the first edge 48A of the membrane section 46A. The first section 58A of the secondary corner angle-iron 37A is welded in a sealed manner to the membrane section 46A of the first secondary reinforcing flange 35A.

Similarly, the secondary metal edge plates 5A of the second tank wall 7 may be anchored in a sealed manner to the edge 85 of the membrane section 54 of the second secondary reinforcing flange 36B. The second section 59A of the secondary corner angle-iron 37A is fixed in a sealed manner to the membrane section 54A of the second secondary reinforcing flange 36B.

A secondary welding strip is fixed in a sealed manner to the edges of two consecutive secondary anchor pieces 32A in the direction of the secondary edge 8A so as to seal the secondary sealing membrane 3A at the level of the secondary edge 8A.

The primary corner thermal insulation elements 9B, 10B and the primary corner pieces (not shown in FIG. 8) have a configuration analogous to that of the secondary corner thermal insulation elements 9A, 10A and the secondary corner pieces 32A.

The sealing members on the plane walls may be produced in various ways. In a variant shown in FIGS. 11 to 15, the primary sealing membrane includes a plurality of corrugated plates as in FIG. 8 and the secondary sealing member is constituted of a plane sealing layer formed for example by a sealed sheet of composite material glued to the secondary insulating barrier as described in FR2691520.

Figure 9:
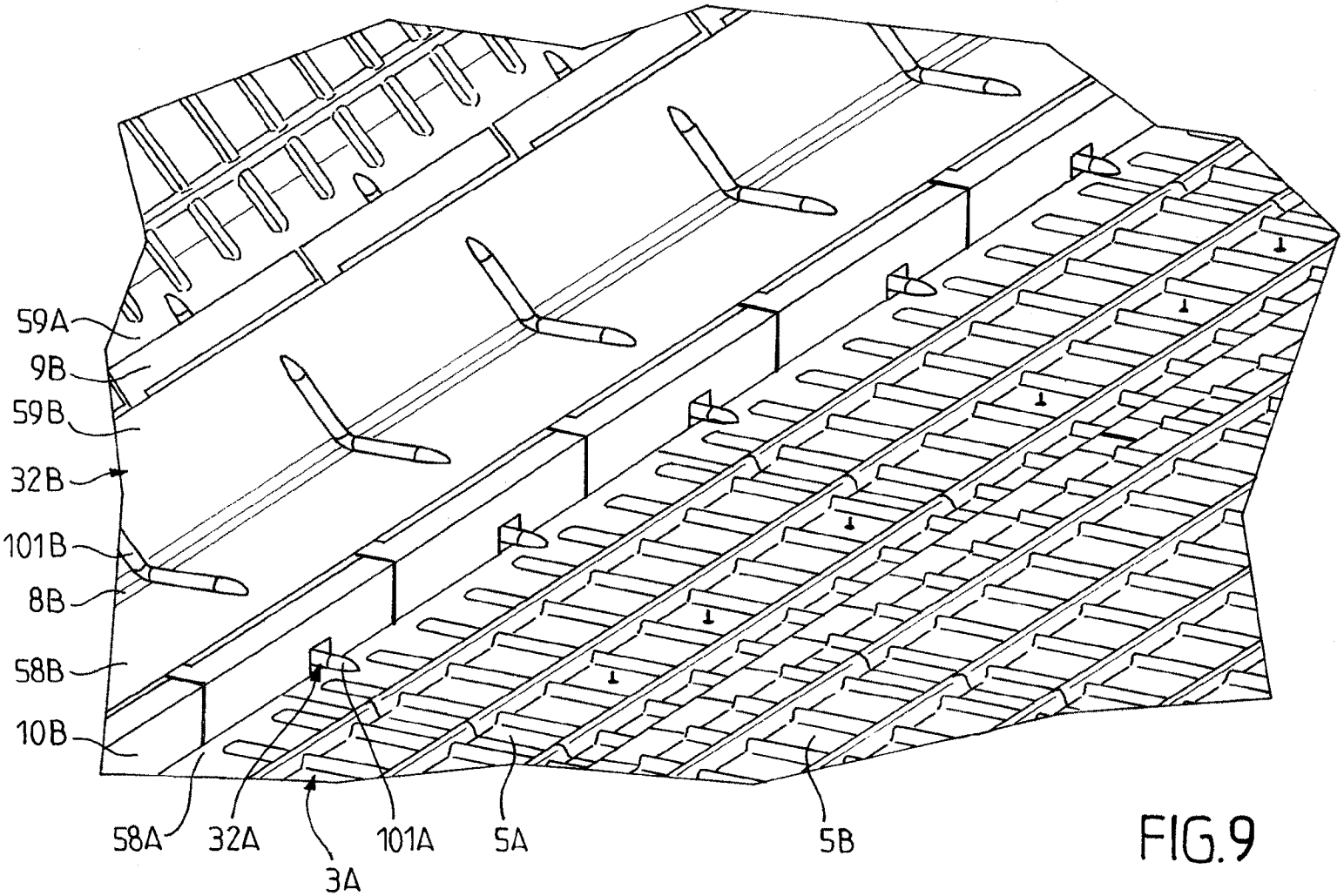
FIG. 9 is a diagrammatic cutaway perspective view of a variant embodiment of a tank corner from FIG. 8 including a plurality of corner angle-irons in accordance with another embodiment.

FIG. 9 is a diagrammatic cutaway perspective view of a variant embodiment of a tank corner from FIG. 8 including a plurality of corner angle-irons in accordance with another embodiment.

In this embodiment, the secondary sealing membrane 3A includes a plurality of juxtaposed secondary corrugated sealing metal plates 5A. These secondary corrugated metal plates 5A may be fixed to one another in a sealed manner. Similarly, a plurality of primary corrugated sealing plates 5B intended to be in contact with the LNG stored in the tank 1 may be fixed to one another in a sealed manner to form the primary sealing membrane 3A.

A plurality of primary corner thermal insulation elements 9B, 10B may be situated along the primary edge 8B. These primary corner thermal insulation elements 9B, 10B rest on a secondary protection shell covering the secondary corner pieces 32A.

A plurality of primary corner pieces 32B may be anchored one after another in the primary groove (not shown). The primary corner angle-irons cover the membrane sections 46B, 54B of the primary reinforcing flanges 35B, 36B of each primary anchor piece 32B.

The primary metal edge plates 5B of the first tank wall 6 may be anchored in a sealed manner to the first section 58B of the primary corner angle-iron 37B and the primary metal edge plate 5B of the second tank wall 7 is welded in a sealed manner to the second section 59B of the primary corner angle-iron 59B.

In this embodiment, the consecutive primary corner pieces 32B along the primary edge 8B overlap as described with reference to FIG. 4. A sealed weld is produced at the edges of two consecutive primary corner pieces 32B in the direction of the primary edge 8B so as to seal the primary sealing membrane 3B at the level of the primary edge 8B. This overlapping and this sealed weld between two consecutive corner pieces makes it possible to avoid the use of any welding strip and therefore limits both the number of parts to be installed and the number of welds to be effected.

In this embodiment, each corner angle-iron 37A, 37B includes a pressed wave 101A, 101B. These waves 101A, 101B are for example centrally located on each corner angle-iron 37A, 37B, halfway between the two opposite edges along the axis of the edge 8 of said corner angle-irons 37A, 37B. These waves 101A, 101B extend from the end of the first section 58A, 58B of the corner angle-irons 37A, 37B to which may be fixed the metal edge plates 5A, 5B of the first tank wall 6 to the edge of the second section 59A, 59B of said corner angle-irons to which may be fixed the metal edge plates 5A, 5B of the second tank wall 7. These waves 101A, 101B advantageously extend in each section 58A, 58B, 59A, 59B of the corner angle-irons 37A, 37B perpendicularly to the axis of the edge 8. The waves 101A, 101B extend toward the interior of the tank.

The secondary protection shell on which the primary thermal insulation elements rest advantageously covers the waves 101A of the secondary corner angle-irons 37A.

Such corner pieces, as well as enabling anchoring of the membranes to the corner thermal insulation elements, offer continuous flexibility along the edge 8 allowing absorption of stresses by deformation of the waves 101A, 101B. When the angle-iron is made of INVAR®, the height of these waves is reduced relative to the height of the waves 101A, 101B situated on the corrugated metal plates, the small contraction of INVAR® allowing only limited deformation of the corner pieces 32.

In another embodiment, the secondary membrane and/or the primary membrane may be constituted of a plurality of strakes with raised edges welded to one another in a sealed manner by means of welding supports, as described in FR2709725. Other metal membranes may also be used.

FIGS. 11 to 15 represent an embodiment in which the plane walls of the tank may be formed from prefabricated parallelepiped-shaped blocks similar to those described in the document FR2691520. The elements similar or identical to those from FIGS. 1 to 9 carry the same reference number increased by 200.

In this embodiment, the tank includes a double membrane. The secondary insulating barrier, the secondary sealing membrane and the primary insulating barrier of the tank are essentially formed by assembling a plurality of juxtaposed prefabricated blocks on the supporting structure. Prefabricated plane blocks 102 (see FIG. 14) are juxtaposed to form the plane walls of the tank and prefabricated corner blocks 103 are disposed at the corners of the tank.

Each prefabricated plane block 102 includes, from the supporting structure 1 in the direction of the interior of the tank:

- a bottom panel 104 of rectangular shape, for example made of plywood,
- a secondary block 105A of insulating foam of rectangular parallelepiped shape,
- a layer 106 of sealing film covering the secondary block 105A of insulating foam,
- a primary block 105B of insulating foam of rectangular parallelepiped shape having smaller dimensions than and disposed coaxially with the secondary block 105A of insulating foam so that the primary block 105B of insulating foam covers only part of the sealing film 106 and leaves exposed a strip 106 of sealing film at the periphery of the prefabricated plane block 102, and
- a cover panel 107, for example made of plywood, covering the primary block 105B of insulating foam.

The layer 106 of sealing film in the prefabricated plane blocks is for example formed of a multilayer composite material including a thin metal sheet sandwiched between two woven fiberglass layers that are glued on. Such a sealing film is known under the tradename TRIPLEX®.

Figure 11:
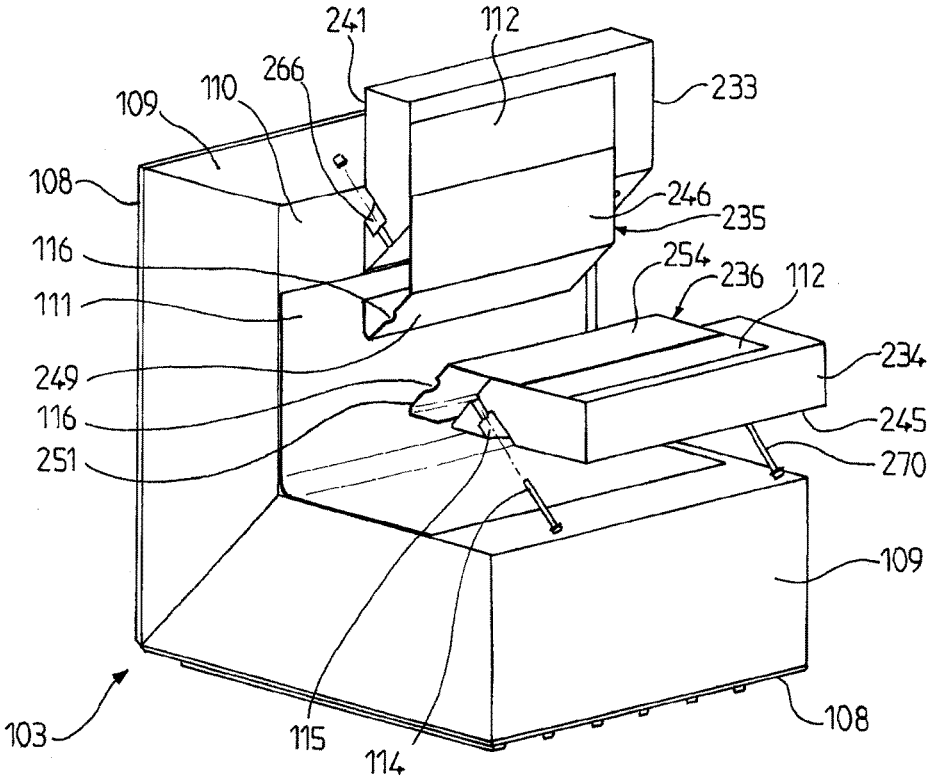
FIG. 11 is a diagrammatic exploded perspective view in which an angle-iron is omitted of a prefabricated corner element used in a corner between two perpendicular walls of a tank in accordance with another embodiment.

Referring to FIG. 11, a prefabricated corner block 103 intended to be installed at a corner of the tank formed by the first tank wall 6 and the second tank wall 7 includes:

- a first bottom panel 108 that extends parallel to the first tank wall,
- a second bottom panel 108 that extends parallel to the second tank wall,
- a first secondary block 109 of insulating foam that extends parallel to the first tank wall,
- a second secondary block 109 of insulating foam that extends parallel to the second tank wall,
- a respective first sealing film 110 covering each of the secondary blocks 109 of insulating foam,
- a second sealing film 111 glued to the first films 110 at the level of the junction between the two blocks 109 of foam to provide the secondary seal at the level of the edge and projecting on either side of the edge,
- the locking pieces 233, 234 glued to the second sealing film 111, and
- the reinforcing flanges 235, 236

In this embodiment, the locking pieces 233, 234 are wider in a direction parallel to the edge 8 and parallel to the tank wall than they are thick in a direction perpendicular to the tank wall.

The upper face of the locking pieces 233, 234 includes a spot facing 112. This spot facing 112 is intended to receive the membrane sections 246, 254 of the reinforcing flanges 235, 236. The membrane sections 246, 254 of the reinforcing flanges 235, 236 may be narrower than the locking pieces 233, 234 so that the membrane sections 246, 254 rest entirely on the locking pieces 233, 234.

In this embodiment, a first screw 270 is disposed at the edge of the locking pieces 233 and 234 beyond the reinforcing flanges 235 and 236 in a similar manner to FIG. 2. The nut housing as described with reference to FIG. 2 is situated on the lower face 241 of the first locking piece 233. Similarly, the screw head housing (not shown in FIG. 11) is situated on the lower face 245 of the second locking piece 234.

For a second screw 114, the nut housing 266 and the screw head housing 115 open onto the lower faces 241, 245 of the locking pieces 233, 234 in line with the reinforcing flanges 235 and 236. Because of this, the junction sections 249, 256 of the reinforcing flanges 235, 236 include holes 116 through which the screw 114 can pass.

The first sealing film 110 is of the same kind as the sealing film 106 used in the prefabricated plane blocks 102. The second sealing film 111 covers only part of the secondary block 109 of insulating foam. The first sealing film 110 is therefore visible over all of a peripheral surface of the prefabricated corner block 103. The locking pieces 233, 234 cover only part of the second sealing film 111 so that a peripheral strip of the second sealing film 111 can be seen all around the locking pieces 233, 234. The locking pieces 233, 234 may be glued directly onto the second sealing film 111.

Figure 12:
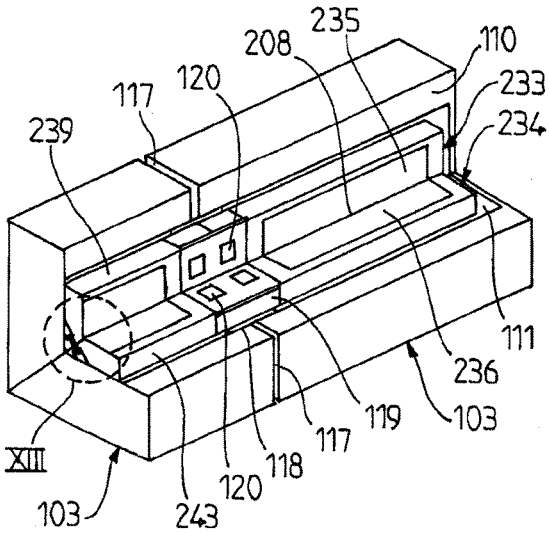
FIG. 12 is diagrammatic partial perspective view of an assembly of two prefabricated corner elements from FIG. 11.

FIG. 12 is a diagrammatic partial perspective view of an assembly of two prefabricated corner blocks from FIG. 11.

In FIG. 12, as in FIG. 11, the primary sealing member is not shown. The juxtaposition of two prefabricated corner blocks 103 forms a joint space 117. The FIG. 12 illustration of this joint space 117 is enlarged purely for a better understanding of the assembly. In practice, the space 117 is made as small as possible and is filled in with insulation, for example with glass wool, during assembly of the tank.

A flexible strip 118 of sealing film covers the space 117 in order to seal the secondary sealing membrane in line with this space 117. The strip 118 of sealing film is glued to the two juxtaposed prefabricated corner blocks 103 on either side of the space 117 and extend to the second sealing film 111 of each prefabricated corner block 103.

In order to ensure the continuity of the primary insulating barrier, an insulating junction block 119 covers the strip 118 of sealing film. Each insulating junction block 119 is generally L-shaped with a first primary layer of insulating foam covered by a first cover panel and a second primary layer of insulating foam covered by a second cover panel. The first primary insulating foam layer and the first cover panel of the insulating junction block 119 each extend parallel to the first tank wall. The second primary insulating foam layer and the second cover panel of the insulating junction block 119 each extend parallel to the second tank wall. An upper face of each cover panel of the insulating junction block 119 includes fixing plates 120.

Figure 14:
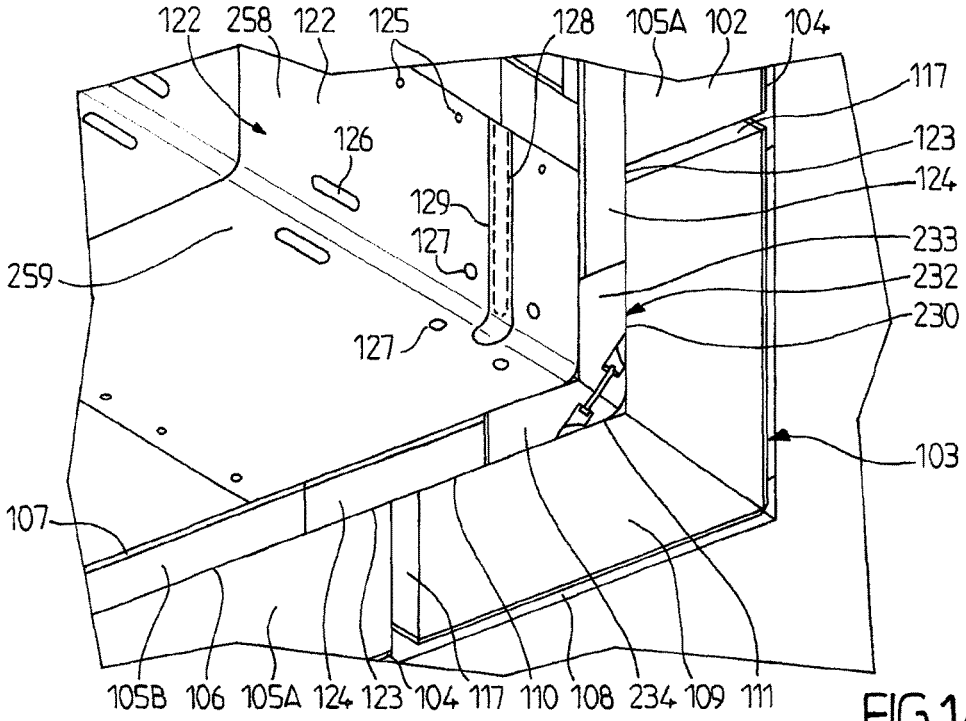
FIG. 14 is a diagrammatic perspective view in section in which the primary membrane is omitted of a tank corner employing the prefabricated corner elements in accordance with the FIG. 11 embodiment in which an angle-iron is arranged along the edge and insulating blocks adjacent the peripheral corner elements.

The insulating junction block 119 extends along the edge 208 contiguously with the locking pieces 233, 234 of the two juxtaposed prefabricated corner blocks 103. The first cover panel of the insulating junction block 119 is flush with the upper surface of the first locking piece 233. The second cover panel of the insulating junction block 119 is flush with the upper surface of the second locking piece 234. Moreover, as also shown in FIG. 14, external lateral faces of the insulating junction blocks 119 may be flush with the external lateral faces 239, 243 of the locking pieces 233, 234.

The prefabricated corner blocks 103 shown in FIG. 12 may be installed in a tank of polygonal cylinder shape on land. Such a tank on land includes a plurality of vertical walls arranged to form a polygonal cylinder. The two prefabricated corner blocks 103 from FIG. 12 therefore have a small angle at the level of the space 117 that corresponds to the angle between two successive sides of the polygon. The general shape of such a tank is described in the document FR2951521, for example.

Figure 13:
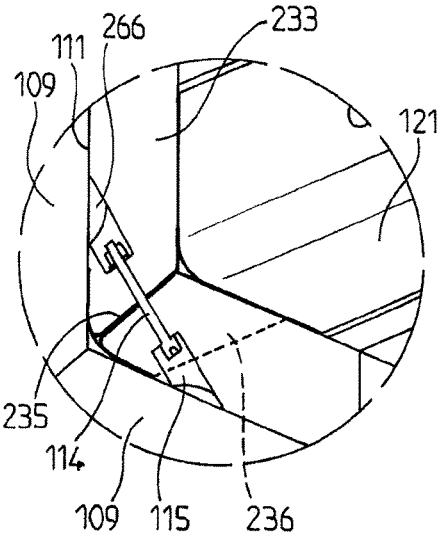
FIG. 13 is a diagrammatic partial perspective view of a prefabricated corner element from FIG. 11 when fitted in which a lower angle-iron is fixed to the reinforcing flanges.

FIG. 13 represents a partial view to a larger scale of the area XIII from FIG. 12 that makes visible a lower corner sheet 121 fixed to the reinforcing flanges 235 and 236. In this embodiment, the angle-iron will finally be produced in two parts as will be described with reference to FIG. 14. The lower corner sheet 121 is welded conjointly to the membrane sections 246, 254 of the reinforcing flanges 235, 236. An upper corner sheet 122 (see FIGS. 14 and 15), for example made of INVAR®, will then be welded conjointly to the lower corner sheet 121 and to the fixing plates 120. As can be seen in FIG. 14, when assembling a tank, the prefabricated plane blocks 102 may be juxtaposed in order to form the plane walls of the tank and the prefabricated corner blocks 103 may be disposed along the edge 208 at the junction of the two plane walls. In addition to the strips 118 of sealing film and the insulating junction blocks 119 described with reference to FIG. 12, secondary strips 123 of sealing film and primary insulating blocks 124 may be installed between all the adjacent prefabricated blocks, in a similar manner to what is described in the document FR2691520. The secondary strips 123 of sealing film may be glued in a sealed manner to the sealing films 106, 110 of the adjacent prefabricated blocks. The primary insulating blocks 124 cover the edge of the adjacent prefabricated blocks 102 and 103. The primary insulating blocks 124 that conjointly cover a prefabricated plane block 102 and a prefabricated corner block 103 may be contiguous on the one hand with the primary block 105B of foam of the prefabricated plane block 102 and on the other hand with the locking piece 233 or 234 extending in the same plane as said primary block 105B of foam.

The primary insulating barrier therefore includes a layer of insulating foam formed by the primary blocks of insulating foam of the prefabricated plane blocks 102, the primary insulating blocks 124 and the junction insulating blocks 119. As can be seen in FIG. 14, this layer of insulating foam includes at the level of the prefabricated corner blocks 103 a groove 230 in which may be accommodated the corner pieces 232 formed by the locking pieces 233, 234 and the reinforcing flanges 235, 236. In the embodiment of FIGS. 11 to 15, the groove 230 therefore extends the full thickness of the primary insulating barrier. The bottom 231 of the groove 230 is therefore formed in this embodiment by the sealing films 110 and 111 of the prefabricated corner block 103. The internal lateral faces of each half-groove may be formed by the sides of the primary insulating blocks 124 conjointly covering the prefabricated corner block 103 and the prefabricated plane block 102.

Figure 15:
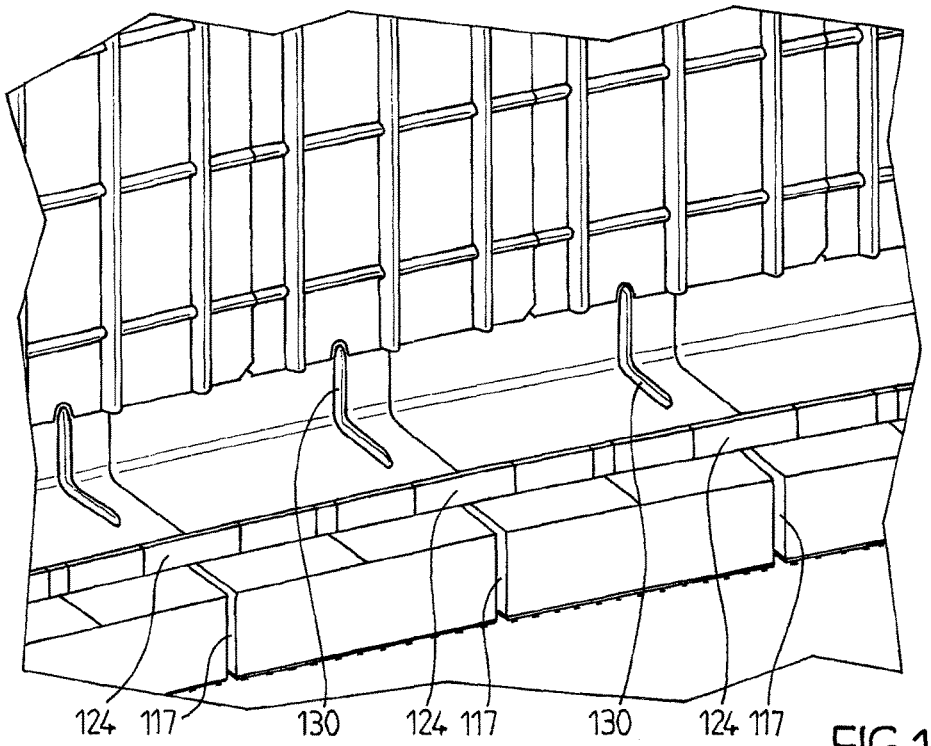
FIG. 15 is a partial perspective view of a corner between a polygonal bottom wall and lateral walls of a polygonal cylindrical tank including prefabricated corner elements in accordance with the FIG. 11 embodiment and showing part of a primary membrane.

In a similar manner to FIG. 12, the spaces 117 formed between two back-to-back prefabricated blocks that are shown in FIGS. 14 and 15 are enlarged to clarify the figures.

FIG. 14 moreover represents an upper corner sheet 122 arranged along the edge 208 on the lower corner sheets 121. The primary membrane is moreover omitted in FIG. 14.

The upper corner sheets 122 shown in FIG. 14 include on the edge of their first and second sections 258, 259 intended to be covered by the sealing membranes of the tank walls fixing holes 125 intended to receive wood screws (not shown) screwed into the plywood cover panels of the insulating blocks 124. These fixing holes 125 are preferably oblong in a direction perpendicular to the edge 208 to preserve a small sliding play of the upper corner sheet 122 relative to the insulating block 124.

The upper corner sheets 122 also include oblong fixing holes 126 situated in line with the lower corner sheet 121. The upper corner sheets 122 may be welded at the level of the edge of the oblong fixing holes 126 to the lower corner sheets 121 in order on the one hand to seal the primary sealing membrane and on the other hand to anchor the upper corner sheets 122 on the lower corner sheets 121. In the same way, the upper corner sheets 122 include circular holes 127 intended to allow anchoring of the upper corner sheets 122 to the fixing plates 120 of the insulating junction blocks 119.

In the context of a cylindrical tank on land, the upper corner sheets 122 have in line with the insulating junction blocks 119 disposed between two prefabricated corner blocks 103 a groove 128 on the vertical tank walls represented in dashed line in FIG. 14. This groove 128 provides sufficient flexibility of the upper corner sheet 122 to extend conjointly over the two juxtaposed prefabricated corner blocks 103 despite the presence of a corner between said two prefabricated corner blocks 103. A sealing strip 129 seals the primary sealing membrane at the level of this groove 128.

In a variant embodiment shown in FIG. 15, the upper corner sheets may include a corrugation 130 extending toward the interior of the tank in order to absorb the stresses at the level of the corners of the tank.

In a variant embodiment that is not shown, the lower corner sheet is omitted and the upper corner sheet 122 is welded directly to the reinforcing flanges 235, 236.

The technique described above for producing a sealed and thermally insulating tank may be used in different types of tank, for example to constitute a sealed and thermally insulating tank of an LNG reservoir in an installation on land or in a floating structure such as a methane tanker or to constitute a sealed and thermally insulating tank of smaller volume to serve as a fuel tank for the propulsion machinery. Such a tank has a volume between 5000 and 30 000 $m^3$.

Figure 10:
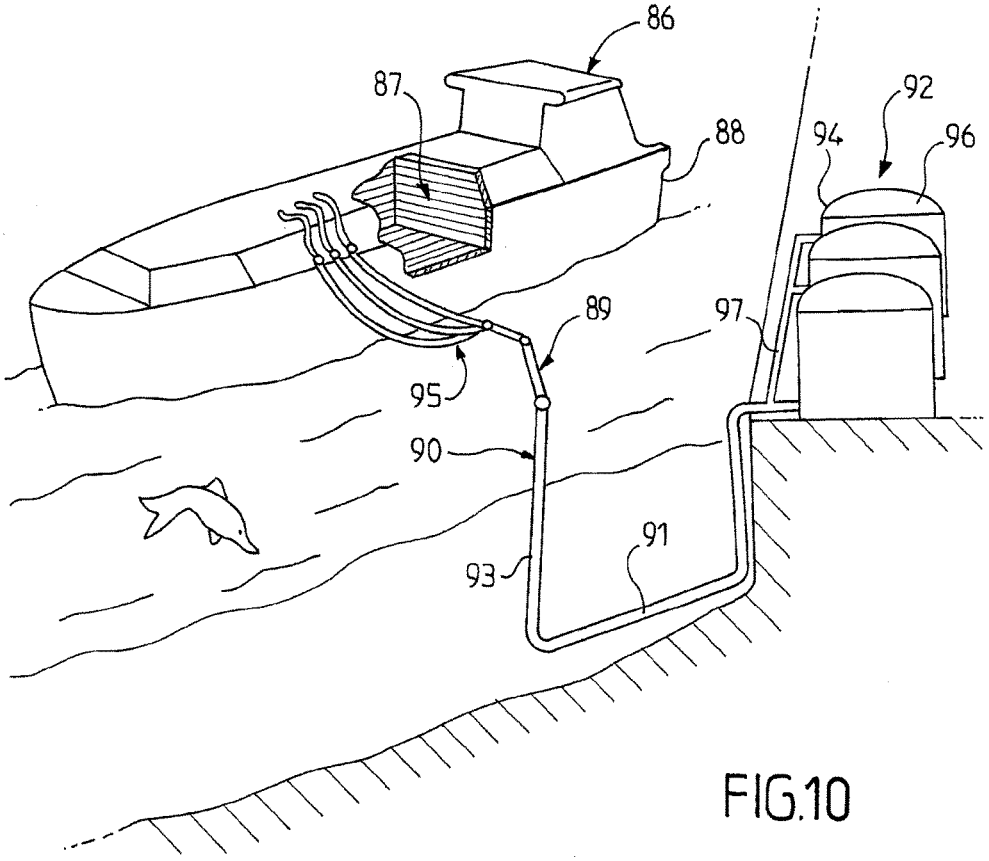
FIG. 10 is a diagrammatic cutaway representation of a sealed and thermally insulating tank integrated into a methane tanker and a terminal for loading/offloading that tank.

Referring to FIG. 10, a cutaway view of a methane tanker 86 shows a sealed and insulated tank 87 of prismatic general shape mounted in the double hull 88 of the ship. The wall of the tank 87 includes a primary sealing barrier intended to be in contact with the LNG contained in the tank, a secondary sealing barrier between the primary sealing barrier and the double hull 8 of the ship, and two insulating barriers between the primary sealing barrier and the secondary sealing barrier and between the secondary sealing barrier and the double hull 88, respectively.

In a manner known in itself, loading/offloading pipes disposed on the upper deck of the ship may be connected by means of appropriate connectors to a maritime or harbor terminal for transferring an LNG cargo from or to the tank 87.

FIG. 10 shows an example of a maritime terminal including a loading and offloading station 90, an underwater pipe 91 and an installation 92 on land. The loading and offloading station 90 is a fixed offshore installation including a mobile arm 89 and a tower 93 that supports the mobile arm 89. The mobile arm 89 carries a bundle of insulated flexible pipes 95 that can be connected to the loading/offloading pipes. The orientable mobile arm 89 adapts to all sizes of methane tanker. A connecting pipe that is not shown extends inside the tower 93. The loading and offloading station 90 enables loading and offloading of the methane tanker 86 from or to the installation 92 on land. The latter includes liquefied gas storage tanks 94, 96 and connecting pipes 97 connected by the underwater pipe 91 to the loading or offloading station 90. The underwater pipe 91 enables the transfer of the liquefied gas between the loading or offloading station 90 and the installation 92 on land over a great distance, for example 5 km, which makes it possible for the methane tanker 86 to remain at a great distance from the shore during the loading and offloading operations.

Pumps on board the ship 86 and/or pumps equipping the installation 92 on land and/or pumps equipping the loading and offloading station 90 may be used to generate the pressure necessary for the transfer of the liquefied gas.

Although the disclosure has been described in connection with a plurality of particular embodiments, it is obvious that is in no way limited to them and that it encompasses all the technical equivalents of the means described and their combinations if the latter fall within the scope of the claim.

Thus corner pieces as described above may also be fitted along any edge of a tank, for example an edge of a tank forming an angle of 90° or any other angle.

Moreover, the first locking piece 33 and/or the second locking piece 34 may be made of any suitable material other than wood, for example high-density foam with a density of the order of 210 kg/m$^3$ or more, for example. The use of such a high-density foam to produce the locking pieces 33, 34 enables homogeneity in the gluing of the locking pieces 33, 34 in the half-grooves 22, 23. Moreover, the use of high-density foam reduces the differential thermal contraction between the corner thermal insulation elements 9, 10 and the locking pieces 33, 34.

Similarly, by preferring anchoring the locking pieces 33, 34 working in traction rather than in shear, the locking pieces 33, 34 can have a lower face 41, 45 larger than their external lateral face 39, 43.

The use of the verb "include" or "comprise" and its conjugate forms does not exclude the presence of elements or steps other than those set out in a claim. The use of the indefinite article "a" or "an" for an element or a step does not exclude the presence of a plurality of such elements or steps unless otherwise indicated.

In the claims, any reference sign between parentheses should not be interpreted as a limitation of the claim.

The invention claimed is:

1. A sealed and thermally insulating tank intended to be integrated into a polyhedral supporting structure, the tank including a plurality of plane tank walls, each tank wall including at least one insulating barrier and at least one sealing membrane, said insulating barrier consisting of a plurality of thermal insulation elements, each thermal insulation element including a block of insulating foam, said insulating barrier carrying a plurality of metal sealing plates fixed to one another in a sealed manner in order to form the sealing membrane, wherein a first tank wall and an adjacent second tank wall form an edge, the tank further including a sealed corner piece situated at the level of the edge, the corner piece including:

a sheet metal corner angle-iron situated along the edge, the corner angle-iron including a first section that extends in the plane of the sealing membrane of the first tank wall and a second section that extends in the plane of the sealing membrane of the second tank wall, a first reinforcing flange and a second reinforcing flange, each reinforcing flange including a respective membrane section and a respective anchor section;

a first locking piece and a second locking piece;

wherein the first and second sections of the corner angle-iron or the first and second reinforcing flanges of the corner piece are fixed in a sealed manner on the one hand to a metal edge plate of the sealing membrane of the first tank wall and on the other hand to a metal edge plate of the sealing membrane of the second tank wall, and in which:

an insulating barrier of the first tank wall includes a first clearance formed in the blocks of insulating foam along the edge, an insulating barrier of the second tank wall includes a second clearance formed in the insulating foam blocks along the edge, the first clearance and the second clearance conjointly forming a groove situated along the edge, a membrane section of the first reinforcing flange extends in the plane of the sealing membrane of the first tank wall between the first section of the corner angle-iron and the insulating barrier of the first tank wall or the first locking piece, the first section of the corner angle-iron being fixed to the membrane section of the first reinforcing flange, a membrane section of the second reinforcing flange extends in the plane of the sealing membrane of the second tank wall between the second section of the corner angle-iron and the insulating barrier of the second tank wall or the second locking piece, the second section of the corner angle-iron being fixed to the membrane section of the second reinforcing flange, an anchor section of the first reinforcing flange, an anchor section of the second reinforcing flange and the first and second locking pieces being accommodated in the groove, the first locking piece is fixed to the insulating barrier of the first tank wall in the first clearance and has an upper surface covered by the membrane section of the first reinforcing flange, the second locking piece is fixed to the insulating barrier of the second tank wall in the second clearance and has an upper surface covered by the membrane section of the second reinforcing flange, the anchor section of the first reinforcing flange and the anchor section of the second reinforcing flange each include a junction section arranged, when the corner piece has been fitted, between the two locking pieces and respectively extending from the membrane section of the first reinforcing flange, respectively second reinforcing flange, to a bottom of the groove, the anchor section of the first reinforcing flange and the anchor section of the second reinforcing flange each include a tab bent against a lower face of the first locking piece, respectively the second locking piece, and arranged at the bottom of the groove, a tab of the first reinforcing flange is fixed to the lower face of the first locking piece and a tab of the second reinforcing flange is fixed to the lower face of the second locking piece.

2. The tank as claimed in claim 1, wherein:

the first clearance includes on the one hand an internal lateral surface extending in the direction of the thickness of the tank wall and on the other hand a bottom, the second clearance includes on the one hand an internal lateral surface extending within the thickness of the tank wall and on the other hand a bottom, the bottom of the first clearance and the bottom of the second clearance conjointly forming the bottom of the groove, the first locking piece includes an external lateral surface opposite the second locking piece, the external lateral face of the first locking piece being fixed to the internal lateral face of the first clearance, the second locking piece includes an external lateral surface opposite the first locking piece, the external lateral face of the second locking piece is fixed to the internal lateral face of the second clearance, the lower face of the first locking piece and the tab of the first reinforcing flange are fixed to the bottom of the first clearance, the lower face of the second locking piece and the tab of the second reinforcing flange are fixed to the bottom of the second clearance.

3. The tank as claimed in claim 1, wherein the lower face of the first locking piece and the lower face of the second locking piece each include a spot facing in which are accommodated the tabs of the first reinforcing flange and of the second reinforcing flange, respectively, and in which a surface of the lower face of the first locking piece not including the spot facing is fixed to the bottom of the first clearance and a surface of the lower face of the second locking piece not including the spot facing is fixed to the bottom of the second clearance.

4. The tank as claimed in claim 1, wherein the first locking piece is connected to the second locking piece by a mechanical element engaged in the locking pieces perpendicularly to the edge.

5. The tank as claimed in claim 4, wherein the mechanical element includes a screw associated with a nut.

6. The tank as claimed in claim 4, wherein:

each locking piece consists of an elongate beam extending along the edge, the beam of the first locking piece extending parallel to the beam of the second locking piece, a plurality of mechanical elements connect the first locking piece and the second locking piece along the beam, the anchor section of the reinforcing flanges extends between the two locking pieces between two consecutive mechanical elements and is interrupted at the level of the mechanical elements.

7. The tank as claimed in claim 4, wherein the insulating barrier of the first tank wall and the insulating barrier of the second tank wall each have an edge surface extending parallel to each other in the direction of the thickness of the tank wall, the edge surfaces of the insulating barrier of the first tank wall and of the second tank wall not being fixed together, and wherein the mechanical element connecting the first locking piece and the second locking piece is elastically deformable in a direction perpendicular to the edge surfaces of the insulating barrier so that the connection between the first locking piece and the second locking piece is elastic.

8. The tank as claimed in claim 1, wherein each wall of the tank includes, from the interior of the tank toward the exterior of the tank:

a primary sealing membrane formed of the plurality of metal sealing plates fixed to one another in a sealed manner, a primary insulating barrier, a secondary sealing membrane formed by a layer of composite film, and a secondary insulating barrier, and in which the primary and secondary insulating barriers each include juxtaposed blocks of insulating foam, the foam blocks of the primary insulating barrier being glued to the secondary sealing membrane, the secondary sealing membrane being glued to the foam blocks of the secondary insulating barrier, the foam blocks of the primary insulating barrier of the first tank wall including the first clearance disposed along the edge and the foam blocks of the primary insulating barrier of the second tank wall including the second clearance disposed along the edge.

9. The tank as claimed in claim 8, wherein the first clearance and the second clearance are formed throughout the thickness of the blocks of insulating foam of the primary insulating barrier of the first tank wall and the second tank wall, respectively, so that the bottom of the groove is formed by the sealed composite film layer of the secondary sealing membrane of the first tank wall and the second tank wall, respectively.

10. The tank as claimed in claim 9, wherein the corner angle-iron includes a lower corner sheet and a superposed upper corner sheet fixed to one another, and wherein the membrane sections of the reinforcing flanges are fixed to the lower corner sheet and the first and second sections of the upper corner sheet cooperate with the edge plates of the primary sealing membrane of the first tank wall and the second tank wall, respectively.

11. The tank as claimed in claim 8, wherein the first locking piece has a length in the plane of the first tank wall greater than the thickness of the primary insulating barrier and wherein the second locking piece has a length in the plane of the second tank wall greater than the thickness of the primary insulating barrier.

12. The tank as claimed in claim 1 wherein the tank has a polygonal cylinder overall shape, the plane walls of the tank including a bottom wall of polygonal shape and a plurality of peripheral lateral walls around the bottom wall and each upstanding from a respective side of the polygonal bottom wall, the tank including a plurality of said corner pieces, each corner piece being arranged at the level of the edge formed between one side of the bottom wall and the corresponding lateral wall.

13. The tank as claimed in claim 1, wherein the insulating barrier of the first tank wall and the insulating barrier of the second tank wall each have an edge surface extending parallel to each other in the direction of the thickness of the tank wall, the edge surfaces of the insulating barrier of the first tank wall and of the second tank wall being glued together.

14. The tank as claimed in claim 1, wherein the anchor section of one of the reinforcing flanges includes, in a plane perpendicular to the edge, a stiffener connecting the junction section and the tab of the reinforcing flange, the locking piece covered by the membrane section of said reinforcing flange including a groove in which the stiffener is accommodated.

15. The tank as claimed in claim 14, wherein a plurality of stiffeners are situated on each reinforcing flange and spaced regularly along the bend between the tab and the junction section, each locking piece including a plurality of grooves in which the plurality of stiffeners are accommodated.

16. The tank as claimed in claim 1, wherein the angle-iron is a continuous metal sheet, the angle-iron and the reinforcing flanges of the corner piece being made of sheet metal with a low coefficient of expansion.

17. The tank as claimed in claim 1, wherein the tab of the first reinforcing flange and the tab of the second reinforcing flange are fixed against the first locking piece and the second locking piece, respectively, by a screw.

18. The tank as claimed in claim 1, wherein the sealing membrane of the first tank wall is fixed in a sealed manner to the first section of the corner angle-iron and wherein the sealing membrane of the second tank wall is fixed in a sealed manner to the second section of the corner angle-iron.

19. The tank as claimed in claim 1, wherein the corner angle-iron extends along the axis of the edge toward the exterior of the corner piece beyond the locking pieces.

20. The tank as claimed in claim 1, wherein the corner angle-iron includes a wave oriented towards the interior of the tank and developed perpendicularly to the edge.

21. A ship for the transportation of a cold liquid product, the ship including:

a double hull; and a sealed and thermally insulating tank disposed in the double hull, the tank including a plurality of plane tank walls, each tank wall including at least one insulating barrier and at least one sealing membrane, said insulating barrier consisting of a plurality of thermal insulation elements, each thermal insulation element including a block of insulating foam, said insulating barrier carrying a plurality of metal sealing plates fixed to one another in a sealed manner in order to form the sealing membrane, wherein a first tank wall and an adjacent second tank wall form an edge, the tank further including a sealed corner piece situated at the level of the edge, the corner piece including:

a sheet metal corner angle-iron situated along the edge, the corner angle-iron including a first section that extends in the plane of the sealing membrane of the first tank wall and a second section that extends in the plane of the sealing membrane of the second tank wall;

a first reinforcing flange and a second reinforcing flange, each reinforcing flange including a respective membrane section and a respective anchor section;

a first locking piece and a second locking piece;

wherein the first and second sections of the corner angle-iron or the first and second reinforcing flanges of the corner piece are fixed in a sealed manner on the one hand to a metal edge plate of the sealing membrane of the first tank wall and on the other hand to a metal edge plate of the sealing membrane of the second tank wall, and in which;

an insulating barrier of the first tank wall includes a first clearance formed in the blocks of insulating foam along the edge;

an insulating barrier of the second tank wall includes a second clearance formed in the insulating foam blocks along the edge, the first clearance and the second clearance conjointly forming a groove situated along the edge;

a membrane section of the first reinforcing flange extends in the plane of the sealing membrane of the first tank wall between the first section of the corner angle-iron and the insulating barrier of the first tank wall or the first locking piece, the first section of the corner angle-iron being fixed to the membrane section of the first reinforcing flange;

a membrane section of the second reinforcing flange extends in the plane of the sealing membrane of the second tank wall between the second section of the corner angle-iron and the insulating barrier of the second tank wall or the second locking piece, the second section of the corner angle-iron being fixed to the membrane section of the second reinforcing flange;

an anchor section of the first reinforcing flange, an anchor section of the second reinforcing flange and the first and second locking pieces being accommodated in the groove;

the first locking piece is fixed to the insulating barrier of the first tank wall in the first clearance and has an upper surface covered by the membrane section of the first reinforcing flange;

the second locking piece is fixed to the insulating barrier of the second tank wall in the second clearance and has an upper surface covered by the membrane section of the second reinforcing flange;

the anchor section of the first reinforcing flange and the anchor section of the second reinforcing flange each include a junction section arranged, when the corner piece has been fitted, between the two locking pieces and respectively extending from the membrane section of the first reinforcing flange, respectively second reinforcing flange, to a bottom of the groove;

the anchor section of the first reinforcing flange and the anchor section of the second reinforcing flange each include a tab bent against a lower face of the first locking piece, respectively the second locking piece, and arranged at the bottom of the groove; and a tab of the first reinforcing flange is fixed to the lower face of the first locking piece and a tab of the second reinforcing flange is fixed to the lower face of the second locking piece.

22. A method of loading or offloading a ship, comprising: obtaining a ship, the ship including;

a double hull; and a sealed and thermally insulating tank disposed in the double hull, the tank including a plurality of plane tank walls, each tank wall including at least one insulating barrier and at least one sealing membrane, said insulating barrier consisting of a plurality of thermal insulation elements, each thermal insulation element including a block of insulating foam, said insulating barrier carrying a plurality of metal sealing plates fixed to one another in a sealed manner in order to form the sealing membrane, wherein a first tank wall and an adjacent second tank wall form an edge, the tank further including a sealed corner piece situated at the level of the edge, the corner piece including:

a sheet metal corner angle-iron situated along the edge, the corner angle-iron including a first section that extends in the plane of the sealing membrane of the first tank wall and a second section that extends in the plane of the sealing membrane of the second tank wall;

a first reinforcing flange and a second reinforcing flange, each reinforcing flange including a respective membrane section and a respective anchor section;

a first locking piece and a second locking piece;

wherein the first and second sections of the corner angle-iron or the first and second reinforcing flanges of the corner piece are fixed in a sealed manner on the one hand to a metal edge plate of the sealing membrane of the first tank wall and on the other hand to a metal edge plate of the sealing membrane of the second tank wall, and in which;

an insulating barrier of the first tank wall includes a first clearance formed in the blocks of insulating foam along the edge;

an insulating barrier of the second tank wall includes a second clearance formed in the insulating foam blocks along the edge, the first clearance and the second clearance conjointly forming a groove situated along the edge;

a membrane section of the first reinforcing flange extends in the plane of the sealing membrane of the first tank wall between the first section of the corner angle-iron and the insulating barrier of the first tank wall or the first locking piece, the first section of the corner angle-iron being fixed to the membrane section of the first reinforcing flange;

a membrane section of the second reinforcing flange extends in the plane of the sealing membrane of the second tank wall between the second section of the corner angle-iron and the insulating barrier of the second tank wall or the second locking piece, the second section of the corner angle-iron being fixed to the membrane section of the second reinforcing flange;

an anchor section of the first reinforcing flange, an anchor section of the second reinforcing flange and the first and second locking pieces being accommodated in the groove;

the first locking piece is fixed to the insulating barrier of the first tank wall in the first clearance and has an upper surface covered by the membrane section of the first reinforcing flange;

the second locking piece is fixed to the insulating barrier of the second tank wall in the second clearance and has an upper surface covered by the membrane section of the second reinforcing flange;

the anchor section of the first reinforcing flange and the anchor section of the second reinforcing flange each include a junction section arranged, when the corner piece has been fitted, between the two locking pieces and respectively extending from the membrane section of the first reinforcing flange, respectively second reinforcing flange, to a bottom of the groove;

the anchor section of the first reinforcing flange and the anchor section of the second reinforcing flange each include a tab bent against a lower face of the first locking piece, respectively the second locking piece, and arranged at the bottom of the groove; and a tab of the first reinforcing flange is fixed to the lower face of the first locking piece and a tab of the second reinforcing flange is fixed to the lower face of the second locking piece; and routing cold liquid product via insulated pipes from or to a floating storage installation or a storage installation on land to or from the tank of the ship.

23. A transfer system for a cold liquid product, including:

a ship, the ship including;

a double hull; and a sealed and thermally insulating tank disposed in the double hull, the tank including a plurality of plane tank walls, each tank wall including at least one insulating barrier and at least one sealing membrane, said insulating barrier consisting of a plurality of thermal insulation elements, each thermal insulation element including a block of insulating foam, said insulating barrier carrying a plurality of metal sealing plates fixed to one another in a sealed manner in order to form the sealing membrane, wherein a first tank wall and an adjacent second tank wall form an edge, the tank further including a sealed corner piece situated at the level of the edge, the corner piece including:

a sheet metal corner angle-iron situated along the edge, the corner angle-iron including a first section that extends in the plane of the sealing membrane of the first tank wall and a second section that extends in the plane of the sealing membrane of the second tank wall;

a first reinforcing flange and a second reinforcing flange, each reinforcing flange including a respective membrane section and a respective anchor section;

a first locking piece and a second locking piece;

wherein the first and second sections of the corner angle-iron or the first and second reinforcing flanges of the corner piece are fixed in a sealed manner on the one hand to a metal edge plate of the sealing membrane of the first tank wall and on the other hand to a metal edge plate of the sealing membrane of the second tank wall, and in which;

an insulating barrier of the first tank wall includes a first clearance formed in the blocks of insulating foam along the edge;

an insulating barrier of the second tank wall includes a second clearance formed in the insulating foam blocks along the edge, the first clearance and the second clearance conjointly forming a groove situated along the edge;

a membrane section of the first reinforcing flange extends in the plane of the sealing membrane of the first tank wall between the first section of the corner angle-iron and the insulating barrier of the first tank wall or the first locking piece, the first section of the corner angle-iron being fixed to the membrane section of the first reinforcing flange;

a membrane section of the second reinforcing flange extends in the plane of the sealing membrane of the second tank wall between the second section of the corner angle-iron and the insulating barrier of the second tank wall or the second locking piece, the second section of the corner angle-iron being fixed to the membrane section of the second reinforcing flange;

an anchor section of the first reinforcing flange, an anchor section of the second reinforcing flange and the first and second locking pieces being accommodated in the groove;

the first locking piece is fixed to the insulating barrier of the first tank wall in the first clearance and has an upper surface covered by the membrane section of the first reinforcing flange;

the second locking piece is fixed to the insulating barrier of the second tank wall in the second clearance and has an upper surface covered by the membrane section of the second reinforcing flange;

the anchor section of the first reinforcing flange and the anchor section of the second reinforcing flange each include a junction section arranged, when the corner piece has been fitted, between the two locking pieces and respectively extending from the membrane section of the first reinforcing flange, respectively second reinforcing flange, to a bottom of the groove;

the anchor section of the first reinforcing flange and the anchor section of the second reinforcing flange each include a tab bent against a lower face of the first locking piece, respectively the second locking piece, and arranged at the bottom of the groove; and a tab of the first reinforcing flange is fixed to the lower face of the first locking piece and a tab of the second reinforcing flange is fixed to the lower face of the second locking piece;

insulated pipes arranged to connect the tank installed in the hull of the ship to a floating storage installation or a storage installation on land; and a pump for driving a flow of cold liquid product via the insulated pipes from or to the floating storage installation or the storage installation on land to or from the tank of the ship.

* * * * *